US010627175B2

(12) United States Patent
Nakamura et al.

(10) Patent No.: US 10,627,175 B2
(45) Date of Patent: Apr. 21, 2020

(54) HEAT EXCHANGER AND REFRIGERATION CYCLE APPARATUS

(71) Applicant: Mitsubishi Electric Corporation, Tokyo (JP)

(72) Inventors: Shin Nakamura, Tokyo (JP); Akira Ishibashi, Tokyo (JP); Sangmu Lee, Tokyo (JP); Satoshi Ueyama, Tokyo (JP); Tsubasa Tanda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 199 days.

(21) Appl. No.: 15/567,395

(22) PCT Filed: May 29, 2015

(86) PCT No.: PCT/JP2015/065680
§ 371 (c)(1),
(2) Date: Oct. 18, 2017

(87) PCT Pub. No.: WO2016/194088
PCT Pub. Date: Dec. 8, 2016

(65) Prior Publication Data

US 2018/0106563 A1 Apr. 19, 2018

(51) Int. Cl.
*F28D 1/04* (2006.01)
*F28F 17/00* (2006.01)
(Continued)

(52) U.S. Cl.
CPC ..... *F28F 17/005* (2013.01); *F28D 1/0535* (2013.01); *F28D 1/05366* (2013.01); *F28F 1/325* (2013.01); *F28F 2215/12* (2013.01)

(58) Field of Classification Search
CPC ..... F28F 17/005; F28F 1/325; F28F 2215/12; F28D 1/0535; F28D 1/05366
(Continued)

(56) References Cited

U.S. PATENT DOCUMENTS 5,170,842 A * 12/1992 Kato ..... F28F 1/325 165/151
5,360,060 A * 11/1994 Tanaka ..... F28F 1/325 165/151
(Continued)

FOREIGN PATENT DOCUMENTS

EP 0 106 480 A2 4/1984
JP H05-340680 A 12/1993
(Continued)

OTHER PUBLICATIONS

International Search Report of the International Searching Authority dated Jul. 21, 2015 for the corresponding international application No. PCT/JP2015/065680 (and English translation).
(Continued)

*Primary Examiner* — Claire E Rojohn, III
(74) *Attorney, Agent, or Firm* — Posz Law Group, PLC

(57) ABSTRACT

A heat exchanger includes a plate fin, a first flat tube intersecting with the plate fin, and a second flat tube opposed to a flat tube lower surface of the first flat tube, the second flat tube being spaced from the first flat tube and arranged so as to intersect with the plate fin. A flat tube windward lateral surface of the first and second flat tubes is located on an inner side of a peripheral edge of the plate fin, which includes an elevated portion formed between the first and second flat tubes and is located between a first imaginary plane, connecting the flat tube windward lateral surface of the first and second flat tubes, and a second imaginary plane, connecting a center of the flat tube lower surface of the first flat tube and a center of the flat tube upper surface of the second flat tube.

8 Claims, 12 Drawing Sheets

(51) Int. Cl.
*F28D 1/053* (2006.01)
*F28F 1/32* (2006.01)

(58) Field of Classification Search
USPC ..... 165/151
See application file for complete search history.

(56) References Cited

U.S. PATENT DOCUMENTS 6,644,389 B1* 11/2003 Kang ..... F28F 1/325 165/146
8,505,618 B2* 8/2013 Ogawa ..... F28F 1/325 165/151
10,393,452 B2* 8/2019 Nakamura ..... F28D 1/05366
2005/0241813 A1* 11/2005 Choi ..... F28D 1/0477 165/151
2009/0050303 A1* 2/2009 Komori ..... F28D 1/0477 165/151
2009/0199585 A1* 8/2009 Ogawa ..... F28D 1/0477 62/324.2
2012/0175101 A1* 7/2012 Tamura ..... F24F 1/18 165/181
2013/0299142 A1 11/2013 Yoshioka et al.
2013/0299153 A1* 11/2013 Jindou ..... F28F 1/325 165/181
2015/0068244 A1 3/2015 Lee et al.
2015/0101362 A1* 4/2015 Lee ..... F28D 1/05383 62/515
2016/0003547 A1* 1/2016 Okazawa ..... F28F 1/32 165/172
2018/0100659 A1* 4/2018 Yoshimura ..... F25B 39/02

FOREIGN PATENT DOCUMENTS

JP H10-160377 A 6/1998
JP 2003-156295 A 5/2003
JP 2005-121318 A 5/2005
JP 2012-163321 A 8/2012
JP 2012-233680 A 11/2012
JP 2012233680 A * 11/2012 ..... F24F 13/22
JP 5177308 B2 1/2013
JP 5523495 B2 4/2014
JP 2014-156990 A 8/2014

OTHER PUBLICATIONS

Extended European Search Report dated Apr. 10, 2018 issued in corresponding EP patent application No. 15894123.7.
Office Action dated May 8, 2018 issued in corresponding JP patent application No. 2017-521351 (and English translation).

* cited by examiner

HEAT EXCHANGER AND REFRIGERATION CYCLE APPARATUS

CROSS REFERENCE TO RELATED APPLICATION

This application is a U.S. national stage application of International Application No. PCT/JP2015/065680, filed on May 29, 2015, the contents of which are incorporated herein by reference.

TECHNICAL FIELD

The present invention relates to a heat exchanger including flat heat transfer tubes, and a refrigeration cycle apparatus.

BACKGROUND

In some of conventional fin-and-tube heat exchangers that employ heat transfer tubes of a flat shape (hereinafter referred to as "flat tube"), a recessed portion of each of plate fins, through which the flat tube is inserted, is located on a windward side in a mainstream direction of airflow, and a plurality of elevated portions (louvers) are formed between the adjacent recessed portions (see, for example, Patent Literature 1). The louvers formed in the fin-and-tube heat exchanger according to Patent Literature 1 are different from each other in length in a vertical direction, transverse width, and pitch in the transverse direction.

PATENT LITERATURE

Patent Literature 1: Japanese Unexamined Patent Application Publication No. 2012-163321

In the heat exchanger according to Patent Literature 1, however, frost is prone to be formed on the side of the recessed portion through which the flat tube is inserted, for example, when the heat exchanger serves as evaporator in an environment where the outdoor temperature falls below zero degrees Celsius. Although the frost is melted by a defrosting operation and turns into water dews, such water dews often reside on an upper portion of the flat tubes in a region close to the recessed portion, without being properly discharged.

SUMMARY

The present invention has been accomplished in view of the foregoing problem, and an object of the present invention is to provide a heat exchanger and a refrigeration cycle apparatus that exhibit an improved drainage performance, to discharge the water generated through the defrosting operation.

A heat exchanger of an embodiment of the present invention is a heat exchanger to which airflow is supplied from a fan. The heat exchanger includes a plate fin, a first flat tube including a first flat surface portion extending in a direction of the airflow supplied from the fan, a first windward end portion located on a windward end portion of the first flat surface portion, and a first leeward end portion located on a leeward end portion of the first flat surface portion, the first flat tube being arranged so as to intersect with the plate fin, and a second flat tube including a second flat surface portion opposed to the first flat surface portion of the first flat tube and extending in the direction of the airflow, a second windward end portion located on a windward end portion of the second flat surface portion, and a second leeward end portion located on a leeward end portion of the second flat surface portion, the second flat tube being spaced from the first flat tube and arranged so as to intersect with the plate fin. The first windward end portion and the second windward end portion are located on an inner side of a peripheral edge of the plate fin. The plate fin includes an elevated portion formed between the first flat tube and the second flat tube. The elevated portion is located between a first imaginary plane connecting the first windward end portion and the second windward end portion, and a second imaginary plane connecting a center of the first flat surface portion and a center of the second flat surface portion.

A refrigeration cycle apparatus of an embodiment of the present invention includes the foregoing heat exchanger.

An embodiment of the present invention discharges a major part of water dews originating from frost, utilizing the gravity. In addition, the water dews stuck to the flat tube can be discharged, because of a capillary action taking place in a space between the elevated portion and the plate fin and because of the gravity. Therefore, the drainage performance to discharge the water generated through the defrosting operation is improved.

DETAILED DESCRIPTION

Embodiment 1

Figure 1:
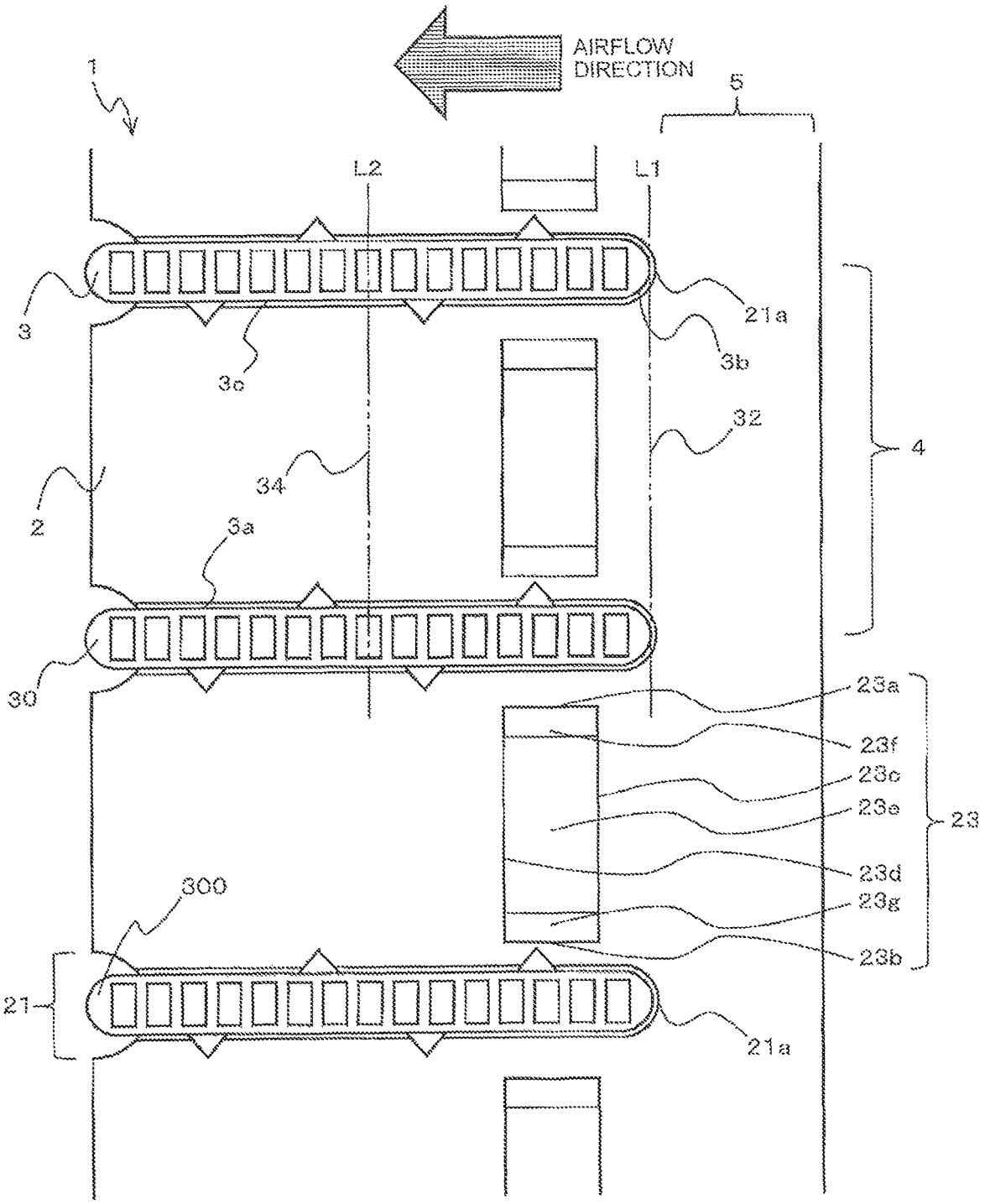
FIG. 1 is a schematic plan view showing a part of a heat exchanger 1 according to Embodiment 1 of the present invention, viewed from an end portion of flat tubes 3, 30, and 300.
Figure 2:
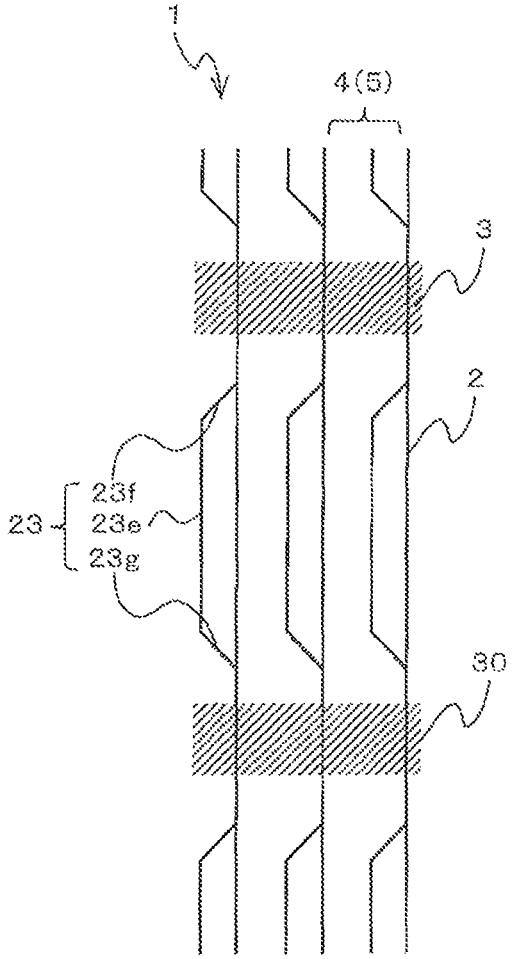
FIG. 2 is a schematic side view showing a part of the heat exchanger 1 according to Embodiment 1 of the present invention, viewed from a windward side (right side in FIG. 1).

Referring to FIG. 1 and FIG. 2, an overall configuration of a heat exchanger 1 according to Embodiment 1 of the present invention will be described. In FIG. 1, FIG. 2, and other drawings, the dimensional relationship among and the shape of the components may differ from the actual one. In the drawings, the same or similar components or portions will be given the same numeral, or such numeral may be omitted.

FIG. 1 is a schematic plan view showing a part of the heat exchanger 1 according to Embodiment 1, viewed from an end portion of flat tubes 3, 30, and 300. FIG. 1 illustrates three flat tubes 3, 30, and 300, and one plate fin 2. In FIG. 1, a direction of airflow supplied from a fan 70, shown in FIG. 6 to be subsequently described, is indicated by a block arrow.

In addition, FIG. 1 includes two imaginary dash-dot-dot lines L1 and L2, to explain the configuration of the heat exchanger 1. The dash-dot-dot line L1 is a straight line drawn between respective flat tube windward lateral surfaces 3*b* of the flat tubes adjacent to and opposing each other (e.g., flat tubes 3 and 30). The dash-dot-dot line L2 is a straight line drawn between the respective centers of flat surface portions of the flat tubes opposing each other (e.g., between the center of a flat tube lower surface 3*c* of the flat tube 3, and the center of a flat tube upper surface 3*a* of the flat tube 30).

Further, for the purpose of explaining the configuration of the heat exchanger 1 according to Embodiment 1, a first imaginary plane 32, extending perpendicularly to the drawing sheet surface, is defined on the dash-dot-dot lines L1, and a second imaginary plane 34, extending perpendicularly to the drawing sheet surface, is defined on the dash-dot-dot lines L2. Thus, the first imaginary plane 32 is defined as an imaginary plane not included in the configuration of the heat exchanger 1, so as to connect the respective flat tube windward lateral surfaces 3*b* of the flat tubes adjacent to and opposing each other (e.g., flat tubes 3 and 30). The second imaginary plane 34 is defined as an imaginary plane not included in the configuration of the heat exchanger 1, so as to connect the respective centers of the flat surface portions of the flat tubes opposing each other (e.g., between the center of the flat tube lower surface 3*c* of the flat tube 3 and the center of the flat tube upper surface 3*a* of the flat tube 30).

FIG. 2 is a schematic side view showing a part of the heat exchanger 1 according to Embodiment 1, viewed from the windward side (right side in FIG. 1). FIG. 2 illustrates three plate fins 2 located at regular intervals. In FIG. 2, two flat tubes 3 and 30 are indicated by hatched regions.

Figure 6:
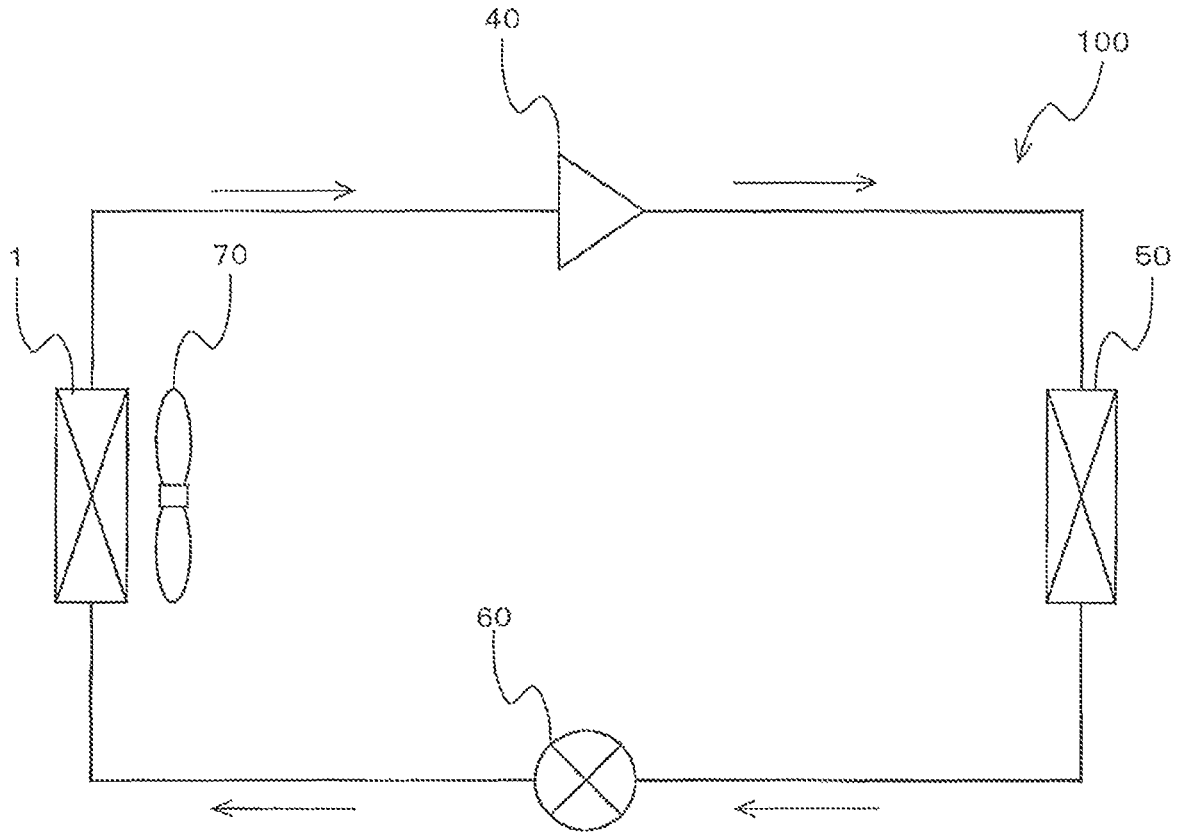
FIG. 6 is a schematic refrigerant circuit diagram of a refrigeration cycle apparatus 100 according to Embodiment 1 of the present invention.

As shown in FIG. 1 and FIG. 2, the heat exchanger 1 according to Embodiment 1 is a fin-and-tube heat exchanger, to which airflow is supplied from the fan 70 (see FIG. 6). The heat exchanger 1 includes a plurality of plate fins 2, and a plurality of flat tubes (in FIG. 1, flat tubes 3, 30, and 300) spaced from each other with the respective flat surface portions opposing each other, and intersecting with the plate fins. The respective flat tube windward lateral surfaces 3*b* of the flat tubes 3, 30, and 300 are located on an inner side of a peripheral edge of the plate fin 2. The plate fin 2 includes elevated portions 23, each formed in a region between the adjacent flat tubes (e.g., a region between the flat tube 3 and the flat tube 30). The plate fins 2 each include a plurality of recessed portions 21, in which the flat tubes 3, 30, and 300 are to be inserted.

The elevated portions 23 are each formed in a slit shape extending in a direction orthogonal to the airflow direction, by cutting and elevating a flat portion on the plate fin 2 located between the plurality of recessed portions 21. The elevated portions 23 are located between the first imaginary plane 32 and the second imaginary plane 34, in other words, on the windward side of the center of the flat tubes 3, 30, and 300.

The elevated portion 23 includes a slit upper end 23*a*, a slit lower end 23*b*, a slit windward edge 23*c*, a slit leeward edge 23*d*, a slit flat portion 23*e*, a slit upper portion 23*f*, and a slit lower portion 23*g*. The slit windward edge 23*c* and the slit leeward edge 23*d* are linear cut portions of the same length, extending in a vertical direction. A line segment connecting the respective upper ends of the slit windward edge 23*c* and the slit leeward edge 23*d* defines the slit upper end 23*a* extending in a horizontal direction. A line segment connecting the respective lower ends of the slit windward edge 23*c* and the slit leeward edge 23*d* defines the slit lower end 23*b* extending in the horizontal direction. The slit flat portion 23*e* is located in a space between the plurality of plate fins 2, so as to extend in the vertical direction when viewed from the windward side. The slit upper portion 23*f* is formed between the slit upper end 23*a* and the upper end of the slit flat portion 23*e*, so as to extend obliquely downward when viewed from the windward side. The slit lower portion 23*g* is formed between the slit lower end 23*b* and the lower end of the slit flat portion 23*e*, so as to extend obliquely upward when viewed from the windward side.

The space between the plate fins 2 adjacent to each other constitutes an airflow path 4 for exchanging heat with outside air. A region of the airflow path 4 on the windward side of the windward end portion 21*a* of the recessed portion 21, in other words, the region of the airflow path 4 on the right of the dash-dot-dot line L1 in FIG. 1, serves as a drainage channel 5 extending in the vertical direction and ensuring discharging of water dews stuck to the heat exchanger 1 by the action of the gravity.

Figure 3:
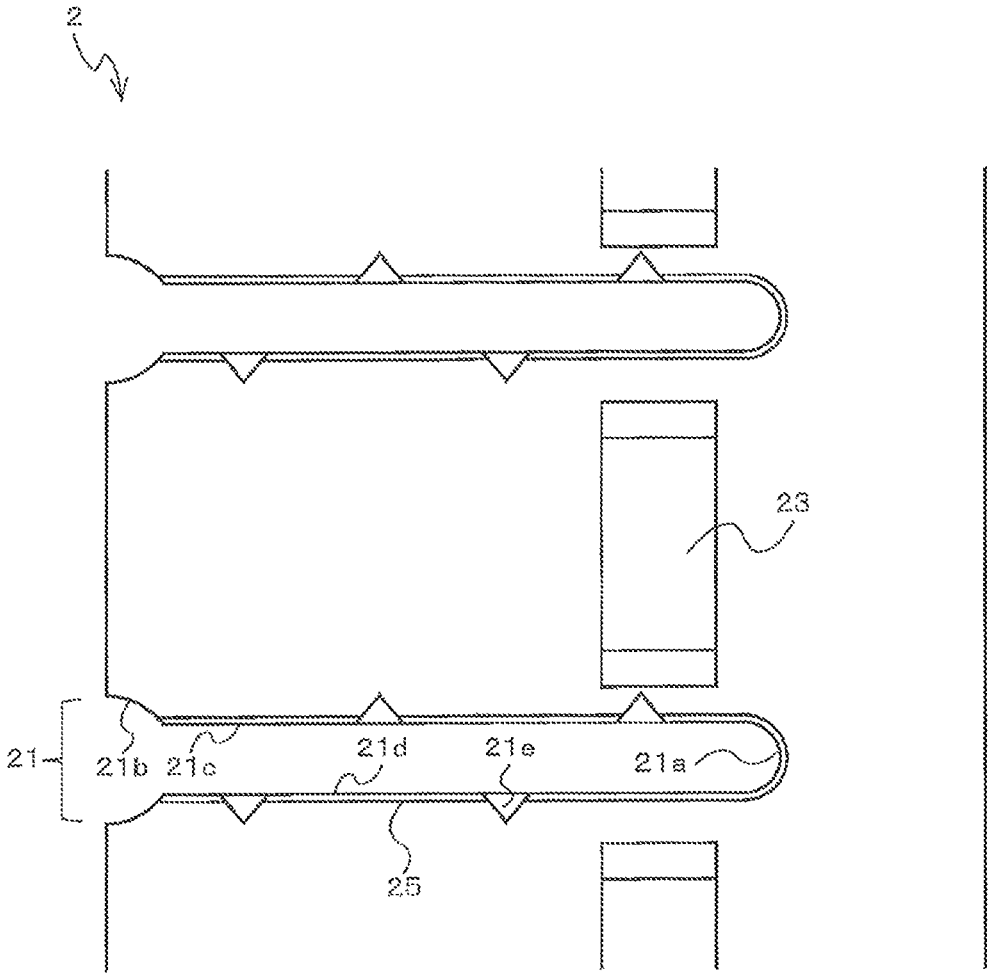
FIG. 3 is a schematic plan view showing a part of a plate fin 2 according to Embodiment 1 of the present invention.
Figure 4:
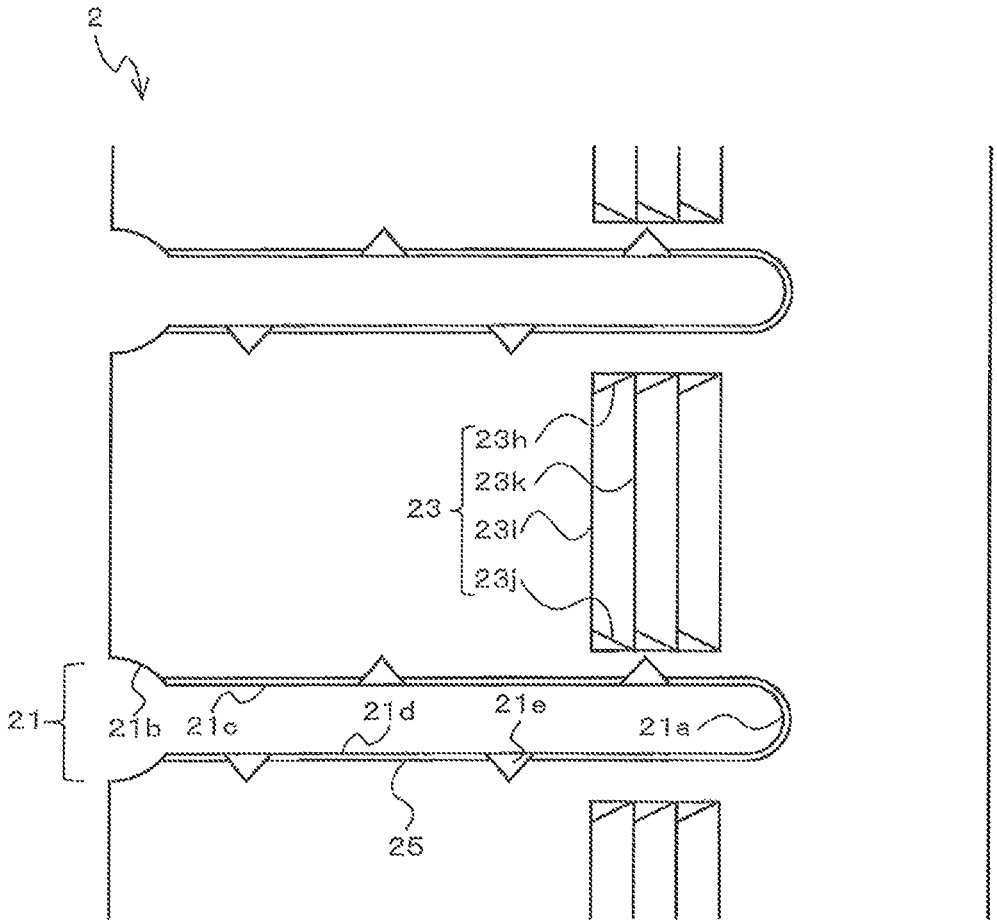
FIG. 4 is a schematic plan view showing a part of the plate fin 2 according to Embodiment 1 of the present invention.

Referring now to FIG. 3 and FIG. 4, a configuration of the plate fin 2 of the heat exchanger 1 according to Embodiment 1 will be described.

FIG. 3 and FIG. 4 are schematic plan views showing a part of the plate fin 2 according to Embodiment 1. As mentioned above, the plate fin 2 includes the plurality of recessed portions 21 and the plurality of elevated portions 23.

The recessed portions 21 each include, as shown in FIG. 3 and FIG. 4, a leeward end portion 21*b* from which the flat tubes 3, 30, and 300 are to be inserted, and a windward end portion 21*a* in which the flat tubes 3, 30, and 300 are to be fitted. The recessed portion 21 also includes a ceiling portion 21*c*, extending between the respective upper portions of the windward end portion 21*a* and the leeward end portion 21*b*. The ceiling portion 21*c* serves to guide the flat tube 3, 30, or 300 inserted from the leeward end portion 21*b*. The recessed portion 21 also includes a bottom portion 21*d*, extending between the respective lower portions of the windward end portion 21*a* and the leeward end portion 21*b*, which serves to guide the flat tube 3, 30, or 300 inserted from the leeward end portion 21*b*. The ceiling portion 21*c* and the bottom portion 21*d* each include a plurality of cutaway portions 21*e* formed in a triangular shape, with the base thereof aligned with the ceiling portion 21*c* or the bottom portion 21*d*.

In FIG. 3 and FIG. 4, the windward end portion 21*a* of the recessed portion 21 has a right semicircular shape. The upper portion and the lower portion of the leeward end portion 21*b* of the recessed portion 21 are formed in an arcuate shape, to facilitate the insertion of the flat tube 3, 30, or 300. The ceiling portion 21*c* of the recessed portion 21 linearly extends in the horizontal direction, between the upper end of the windward end portion 21*a* and the right lower end of the upper portion of the leeward end portion 21*b*. The bottom portion 21*d* of the recessed portion 21 linearly extends in the horizontal direction, between the lower end of the windward end portion 21*a* and the right upper end of the lower portion of the leeward end portion 21*b*. However, the respective shapes of the windward end portion 21*a*, the leeward end portion 21*b*, the ceiling portion 21*c*, and the bottom portion 21*d* of the recessed portion 21 are not specifically limited, provided that the flat tubes 3, 30, and 300 can be inserted and fixed. For example, the windward end portion 21*a* of the recessed portion 21 may have a semielliptical shape, and the leeward end portion 21*b* may have a different tapered shape.

Here, the plate fin 2 according to Embodiment 1 may include the elevated portions 23 formed in a louver shape, instead of in the slit shape. The plate fin 2 shown in FIG. 4 includes three elevated portions 23 of the louver shape, formed in the flat regions between the plurality of recessed portions 21. In FIG. 4, the elevated portions 23 of the louver shape each include a louver upper edge 23*h*, a louver left edge 23*i*, a louver lower edge 23*j*, and a louver right edge 23*k*. The louver left edge 23*i* is a linear cut portion extending in the vertical direction. The louver upper edge 23*h* is a linear cut portion extending in the horizontal direction, from the upper end of the louver left edge 23*i* to the right (windward side). The louver lower edge 23*j* is a linear cut portion having the same length as the louver upper edge 23*h*, and extending in the horizontal direction from the lower end of the louver left edge 23*i* to the right (windward side). A line segment connecting the right end of the louver upper edge 23*h* and the right end of the louver lower edge 23*j* defines the louver right edge 23*k*. The elevated portions 23 of the louver shape are each formed by cutting and elevating the flat region between the plurality of recessed portions 21, so as to bend obliquely about the louver right edge 23*k*.

The plate fins 2 each include a fin collar 25 perpendicularly erected from the windward end portion 21*a*, the ceiling portion 21*c*, and the bottom portion 21*d* of the recessed portion 21. The fin collar 25 serves to fix the flat tubes 3, 30, and 300 to the plate fin 2.

Hereunder, a configuration of the flat tubes 3, 30, and 300 of the heat exchanger 1 according to Embodiment 1 will be described with reference to FIG. 5.

Figure 5:
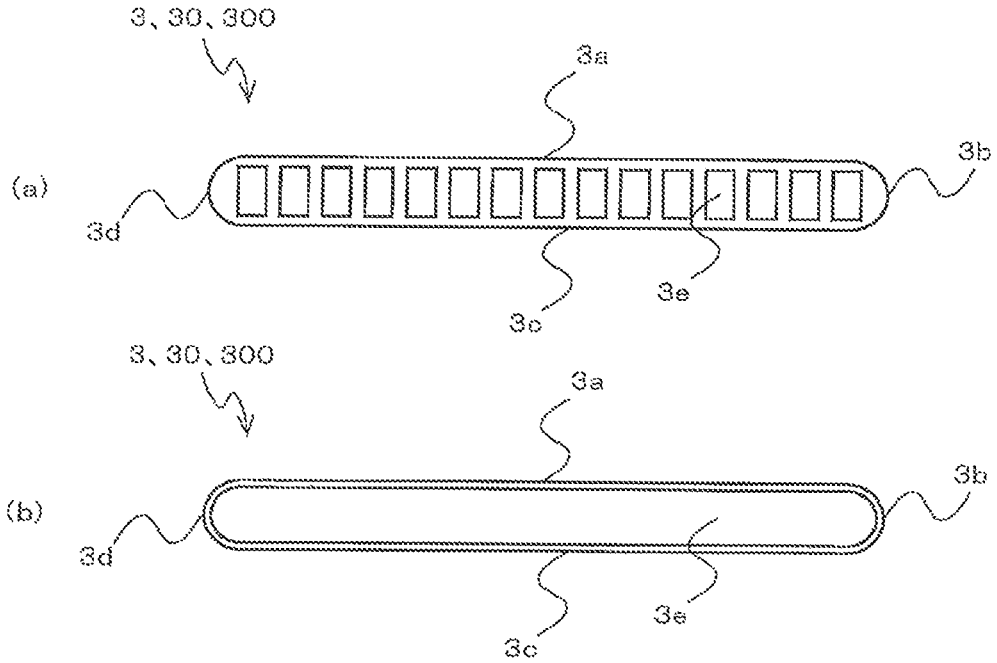
FIG. 5 includes schematic plan views of flat tubes 3, 30, and 300 according to Embodiment 1 of the present invention, viewed from the end portions.

FIG. 5 includes schematic plan views of the flat tubes 3, 30, and 300 according to Embodiment 1, viewed from the end portions. The flat tubes 3, 30, and 300 each serve as a refrigerant pipe having a flat end face (cross-section) of, for example, an elliptical or elongated elliptical shape. The flat tubes 3, 30, and 300 may each be a straight refrigerant pipe or a U-shaped refrigerant pipe.

The flat tubes 3, 30, and 300 shown in FIG. 5 are straight refrigerant pipes, each having an end face (cross-section) of an elongated elliptical shape. The flat tubes 3, 30, and 300 each include a flat tube upper surface 3*a* of a flat shape, a flat tube windward lateral surface 3*b* of a right semicircular shape, a flat tube lower surface 3*c* of a flat shape, and a flat tube leeward lateral surface 3*d* of a left semicircular shape. The flat tube upper surface 3*a* and the flat tube lower surface 3*c* correspond to the flat surface portions of the flat tubes 3, 30, and 300, extending in the direction of the airflow supplied from the fan 70. The flat tube windward lateral surface 3*b* corresponds to the windward end portion of the flat tubes 3, 30, and 300, located on the respective windward end portions of the flat tube upper surface 3*a* and the flat tube lower surface 3*c*. The flat tube leeward lateral surface 3*d* corresponds to the leeward end portion of the flat tubes 3, 30, and 300, located on the respective leeward end portions of the flat surface portions of the flat tube upper surface 3*a* and the flat tube lower surface 3*c*.

The flat tubes 3, 30, and 300 may each include thereinside, as shown in (a) of FIG. 5, a plurality of refrigerant flow paths 3*e* of a rectangular shape, to increase the contact area with the refrigerant to thereby improve heat exchange efficiency. Alternatively, as shown in (b) of FIG. 5, the flat tubes 3, 30, and 300 may each include thereinside a single, concentrically formed refrigerant flow path 3*e*.

Hereunder, a refrigeration cycle apparatus 100 including the heat exchanger 1 according to Embodiment 1 will be described.

FIG. 6 is a schematic refrigerant circuit diagram of a refrigeration cycle apparatus 100 according to Embodiment 1. Arrows in FIG. 6 indicate the flow direction of the refrigerant in the refrigeration cycle apparatus 100.

The refrigeration cycle apparatus 100 according to Embodiment 1 includes a refrigeration cycle, in which a compressor 40, a load-side heat exchanger 50, a pressure reducing device 60, and the heat exchanger 1 (heat source-side heat exchanger) of Embodiment 1 are connected via a refrigerant pipe. The refrigeration cycle apparatus 100 according to Embodiment 1 is configured to circulate the refrigerant in the refrigeration cycle, to perform a heating operation including supplying low-temperature and low-pressure refrigerant to the heat exchanger 1.

The compressor 40 is a fluid machine that compresses the low-pressure refrigerant sucked thereinto, and discharges the compressed refrigerant as high-pressure refrigerant. The load-side heat exchanger 50 serves as radiator (condenser) in the heating operation. The pressure reducing device 60 reduces the pressure of the high-pressure refrigerant, thereby turning it into low-pressure refrigerant. The pressure reducing device can be typically exemplified by a linear electronic expansion valve, the opening degree of which is variable. The heat exchanger 1 according to Embodiment 1 serves as evaporator, when the refrigeration cycle apparatus 100 performs the heating operation.

The refrigeration cycle apparatus 100 according to Embodiment 1 also includes the fan 70 that supplies outside air to the heat exchanger 1 of Embodiment 1. The fan 70 is opposed to the heat exchanger 1. The fan 70 is, for example, a propeller fan, which generates, upon being driven to rotate, the airflow passing through the airflow path 4 of the heat exchanger 1.

Hereunder, a water drainage operation of the heat exchanger 1 according to Embodiment 1, performed during the heating operation of the refrigeration cycle apparatus 100, will be described.

The high-temperature and high-pressure gas-phase refrigerant discharged from the compressor 40 flows into the load-side heat exchanger 50. In the load-side heat exchanger 50, for example, the refrigerant flowing through the load-side heat exchanger 50 exchanges heat with the outside air (indoor air), so that the condensing heat of the refrigerant is transferred to the outside air supplied, and thus the high-temperature and high-pressure gas-phase refrigerant, which has entered the load-side heat exchanger 50, turns into two-phase refrigerant, and then to high-pressure liquid-phase refrigerant. The high-pressure liquid-phase refrigerant flows into the pressure reducing device 60, to be depressurized thus to turn into low-pressure two-phase refrigerant, and flows into the heat exchanger 1. In the heat exchanger 1, the refrigerant flowing through the heat exchanger 1 exchanges heat with the outside air (outdoor air) supplied from the fan 70, so that the evaporating heat of the refrigerant is removed from the outside air supplied. Accordingly, the low-pressure two-phase refrigerant that has entered the heat exchanger 1 turns into low-pressure gas-phase refrigerant, or low-pressure two-phase refrigerant of high quality. The low-pressure gas-phase refrigerant, or the high-quality low-pressure two-phase refrigerant is sucked into the compressor 40. The low-pressure gas-phase refrigerant sucked into the compressor 40 is compressed, thus to turn into high-temperature and high-pressure gas-phase refrigerant. When the refrigeration cycle apparatus 100 performs the heating operation, the foregoing cycle is repeated.

When the refrigeration cycle apparatus 100 performs the heating operation, a heat-exchange fluid, such as the air supplied from the fan 70 and passing through the airflow path 4 of the heat exchanger 1 exchanges heat with a fluid that is the object of heat exchange, such as water or refrigerant, flowing inside the flat tubes 3, 30, and 300 in the heat exchanger 1. During such heat exchange, the moisture in the air is condensed and water dews are formed on the surface of the heat exchanger 1.

In the case where, for example, the heat exchanger 1 is accommodated in a non-illustrated outdoor unit of the refrigeration cycle apparatus 100 (e.g., air-conditioning apparatus), and serves as evaporator when the air-conditioning apparatus performs the heating operation, the moisture in the air may form frost on the heat exchanger 1. Accordingly, the air-conditioning apparatus, or a similar apparatus capable of performing the heating operation, is configured to perform a defrosting operation to remove the frost, when a temperature of the outside air drops to a certain level (e.g., equal to or lower than 0 degrees Celsius).

Here, the term "defrosting operation" refers to an operation to supply hot gas (high-temperature and high-pressure gas refrigerant) from the compressor 40 to the heat exchanger 1, to prevent frost formation on the heat exchanger 1 serving as evaporator. The frost and ice stuck to the heat exchanger 1 are melted by the hot gas supplied to the heat exchanger 1 during the defrosting operation.

The outlet of the compressor and the heat exchanger 1 may be connected via a non-illustrated bypass refrigerant pipe, to allow the hot gas to be directly supplied to the heat exchanger 1 from the compressor 40, during the defrosting operation. In addition, the outlet of the compressor 40 may be connected to the heat exchanger 1 via a refrigerant flow switching device (e.g., four-way valve), to allow the hot gas to be supplied to the heat exchanger 1 from the compressor 40.

The defrosting operation may be performed when the duration of the heating operation has reached a predetermined value (e.g., 30 minutes), or before the heating operation is started, when the temperature of the outside air is equal to or lower than a certain level (e.g., minus 6 degrees Celsius).

In the heat exchanger 1 according to Embodiment 1, the flat tubes 3, 30, and 300 are located in the leeward region of the plate fin 2. Accordingly, the drainage channel 5 of the heat exchanger 1 is located in the windward region, in the mainstream direction of the air supplied from the fan 70. Therefore, a major part of the frost is formed in the windward region of the heat exchanger 1, in other words, in the drainage channel 5 of the heat exchanger 1. The frost and ice stuck to the drainage channel 5 of the heat exchanger 1 are melted by the defrosting operation, thereby turning into water dews, and the water dews are discharged from the heat exchanger 1 through the drainage channel 5, owing to the gravity.

In the heat exchanger 1 according to Embodiment 1, the elevated portions 23 are located between the first imaginary plane 32 and the second imaginary plane 34. The water dews, formed on the flat tube lower surface 3*c* during the defrosting operation, are driven downward by a capillary action taking place in a space between the elevated portion 23 and the plate fin 2 and by the gravity, and fall onto the flat tube upper surface 3*a*. In this case, since the elevated portion 23 is located close to the flat tube windward lateral surface 3*b* on the drainage channel 5 side, the water dews that have fallen migrate to the flat tube lower surface 3*c* through the flat tube windward lateral surface 3*b*, without residing on the flat tube upper surface 3*a*. The water dews formed on the flat tube lower surface 3*c* are discharged downward, by the capillary action taking place in a space between the elevated portion 23 and the plate fin 2, and to the gravity. Through repetitions of the mentioned process, the heat exchanger 1 according to Embodiment 1 can effectively discharge the water dews formed on the flat tubes 3, 30, and 300 during the defrosting operation.

As described above, the heat exchanger 1 according to Embodiment 1, to which airflow is supplied from the fan 70, includes the plate fin 2, the flat tube 3 (exemplifying the first flat tube) including the flat tube lower surface 3*c* (exemplifying the first flat surface portion) extending in the direction of the airflow supplied from the fan 70, the flat tube windward lateral surface 3*b* (first windward end portion) located on the windward end portion of the flat tube lower surface 3*c*, and the flat tube leeward lateral surface 3*d* (first leeward end portion) located on the leeward end portion of the flat tube lower surface 3*c*, the flat tube 3 being arranged so as to intersect with the plate fin 2, and the flat tube 30 (exemplifying the second flat tube) including the flat tube upper surface 3*a* (exemplifying the second flat surface portion) opposed to the flat tube lower surface 3*c* of the flat tube 3 and extending in the direction of the airflow, the flat tube windward lateral surface 3*b* (second windward end portion) located on the windward end portion of the flat tube upper surface 3*a*, and the flat tube leeward lateral surface 3*d* (second leeward end portion) located on the leeward end portion of the flat tube upper surface 3*a*, the flat tube 30 being spaced from the flat tube 3 and arranged so as to intersect with the plate fin 2. The flat tube windward lateral surface 3*b* of the flat tube 3 and the flat tube windward lateral surface 3*b* of the flat tube 30 are located on the inner side of the peripheral edge of the plate fin 2. The plate fin 2 includes the elevated portion 23 formed between the flat tube 3 and the flat tube 30. The elevated portion 23 is located between the first imaginary plane 32, connecting the flat tube windward lateral surface 3*b* of the flat tube 3 and the flat tube windward lateral surface 3*b* of the flat tube 30, and the second imaginary plane 34, connecting the center of the flat tube lower surface 3*c* of the flat tube 3 and the center of the flat tube upper surface 3*a* of the flat tube 30. Further, the refrigeration cycle apparatus 100 according to Embodiment 1 includes the heat exchanger 1 configured as above.

Figure 7:
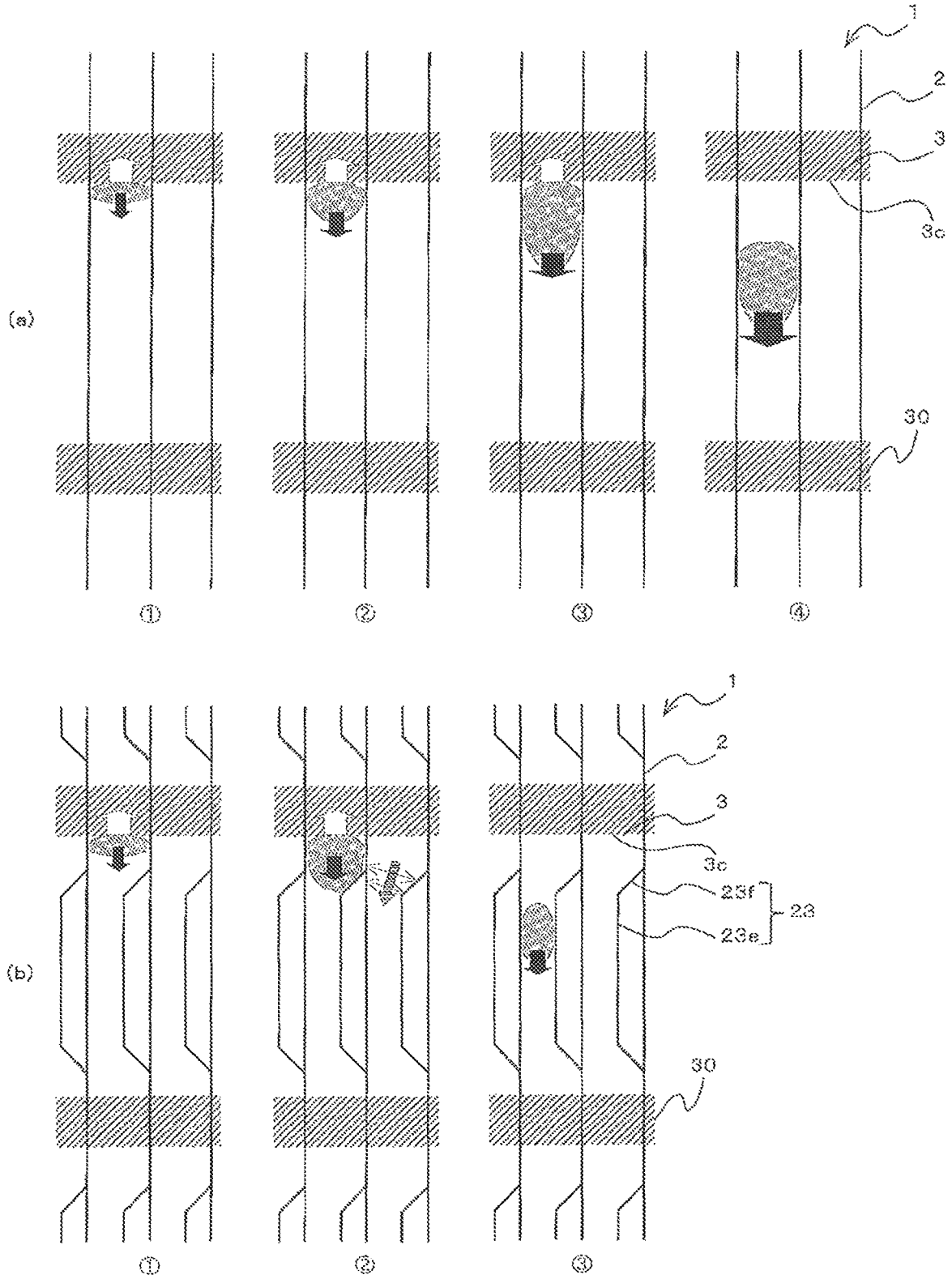
FIG. 7 incudes schematic side views for explaining water drainage performance of the heat exchanger 1 according to Embodiment 1 of the present invention.
Figure 8:
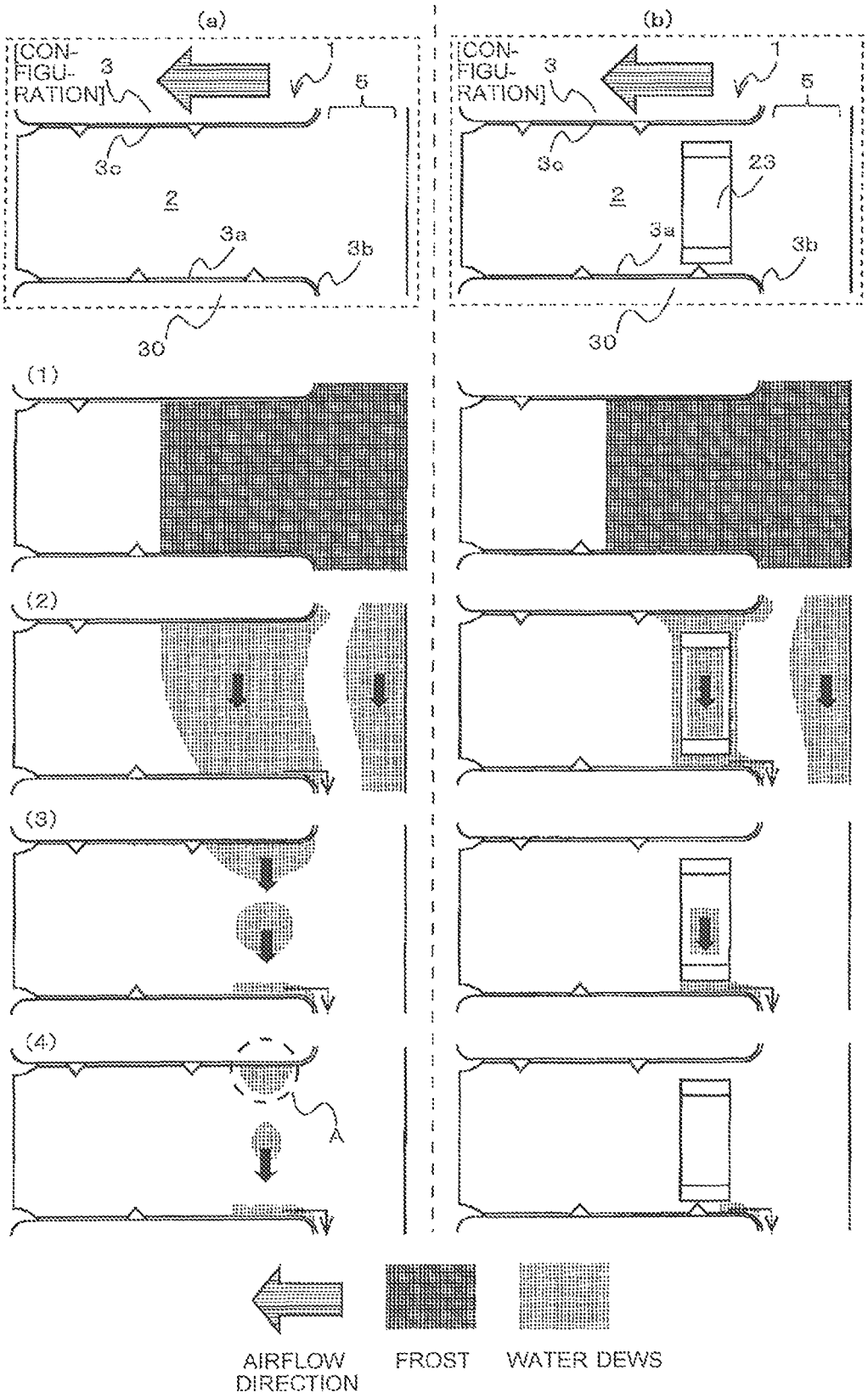
FIG. 8 includes schematic plan views for explaining the water drainage performance of the heat exchanger 1 according to Embodiment 1 of the present invention.

Referring to FIG. 7 and FIG. 8, description will be given regarding the advantageous effects of the heat exchanger 1 and the refrigeration cycle apparatus 100 according to Embodiment 1, attained because of the presence of the elevated portions 23 on the plate fin 2 of the heat exchanger 1.

FIG. 7 incudes schematic side views for explaining the water drainage performance of the heat exchanger 1 according to Embodiment 1. In FIG. 7, blank block arrows represent a normal force mainly originating from surface tension, solid block arrows represent the gravity, and a hatched block arrow represents a force originating from a capillary action. FIG. 7 shows the comparison between the heat exchanger 1 without the elevated portion 23 (configuration (a)), and the heat exchanger 1 according to Embodiment 1 having the slit-shaped elevated portions 23 (configuration (b)).

As shown in (a) of FIG. 7, in the case where the heat exchanger 1 is without the elevated portion 23, a water dew formed on the flat tube lower surface 3*c* resides thereon, owing to the balance between the normal force mainly originating from the surface tension, and the gravity (No. 1 of (a)). With an increase in amount of the water migrating to the flat tube lower surface 3*c* through the flat tube windward lateral surface 3*b*, the water dew swells downward. However, the water dew remains stuck to the flat tube lower surface 3*c*, until the gravity overcomes the normal force mainly originating from the surface tension (No. 2 to No. 3). When the gravity exceeds the normal force mainly originating from the surface tension, owing to further increase in amount of the water migrating to the flat tube lower surface 3*c*, the water dew is separated from the flat tube lower surface 3*c*, and discharged downward (No. 4). In the heat exchanger 1 of (a) of FIG. 7, therefore, the water dew is discharged at a limited rate.

In contrast, in the heat exchanger 1 of (b) of FIG. 7, which includes the slit-shaped elevated portions 23, the water dew resides on the flat tube lower surface 3*c*, owing to the balance between the normal force mainly originating from the surface tension and the gravity, while the water dew formed on the flat tube lower surface 3*c* is still small (No. 1). With an increase in amount of the water migrating to the flat tube lower surface 3*c* through the flat tube windward lateral surface 3*b*, the water dew swells downward, and contacts the slit upper portion 23*f* (No. 2). At this point, a force is generated from the capillary action, in the space between the plate fin 2 and the slit upper portion 23*f*. When a resultant force of the capillary action and the gravity exceeds the normal force mainly originating from the surface tension, the water dew is separated from the flat tube lower surface 3*c*, and discharged downward through the space between the slit flat portion 23*e* and the plate fin 2 (No. 3). In the heat exchanger 1 of (b) of FIG. 7, therefore, since the water dew residing on the flat tube lower surface 3*c* can be discharged with the resultant force of the capillary action and the gravity, the water dew can be more quickly discharged.

FIG. 8 includes schematic plan views for explaining the water drainage performance of the heat exchanger 1 according to Embodiment 1. In FIG. 8, solid block arrows represent the gravity, and solid line arrows represent the flow direction of water dews. FIG. 8 shows the comparison between the heat exchanger 1 without the elevated portion 23 (configuration (a)), and the heat exchanger 1 according to Embodiment 1 having the slit-shaped elevated portions 23 (configuration (b)).

As shown in (a) of FIG. 8, in the case where the heat exchanger 1 is without the elevated portion 23, frost and ice are stuck to the windward region of the heat exchanger 1 (No. 1). A major part of the water dews, stuck to the drainage channel 5 during the defrosting operation, is discharged from the heat exchanger 1 through the drainage channel 5, owing to the gravity (NO. 2). In addition, the water dews formed on the flat tube lower surface 3*c* during the defrosting operation fall onto the flat tube upper surface 3*a*, when the gravity of the water dews exceeds the normal force mainly originating from the surface tension (NO. 2). The water dews that have fallen onto the flat tube upper surface 3*a* migrate to the flat tube lower surface 3*c* through the flat tube windward lateral surface 3*b* (No. 3). When the gravity of the water dews formed on the flat tube lower surface 3*c* is smaller than the normal force mainly originating from the surface tension, the water dews remain stuck to the flat tube lower surface 3*c* (No. 4). In the heat exchanger 1 shown in (a) of FIG. 8, therefore, the drainage rate of the water dews becomes more limited with the lapse of time, and the water dews reside in the region of the flat tube lower surface 3*c* close to the drainage channel 5, in other words, on the windward side (remainder A of No. 4).

In contrast, in the heat exchanger 1 according to Embodiment 1 shown in (b) of FIG. 8, which includes the slit-shaped elevated portions 23, frost and ice are stuck to the windward region of the heat exchanger 1 (No. 1). A major part of the water dews, stuck to the drainage channel 5 during the defrosting operation, is discharged from the heat exchanger 1 through the drainage channel 5, owing to the gravity (NO. 2). In addition, the water dews formed on the flat tube lower surface 3*c* during the defrosting operation are discharged to the flat tube upper surface 3*a* through the elevated portion 23, owing to the capillary action and the gravity (No. (2). The water dews discharged to the flat tube upper surface 3*a* migrate to the flat tube lower surface 3*c* through the flat tube windward lateral surface 3*b* (No. 3). In the heat exchanger 1 shown in (b) of FIG. 8, therefore, the drainage rate of the water dews can be improved, and thus the amount of the water dews residing on the flat tube lower surface 3*c* can be reduced (No. 4).

Thus, Embodiment 1 provides, by forming the elevated portions 23 on the plate fins 2 of the heat exchanger 1, the heat exchanger 1 and the refrigeration cycle apparatus 100 capable of improving the drainage rate of the water dews, thereby reducing the amount of the water dews residing on the flat tube lower surface 3*c*.

Figure 9:
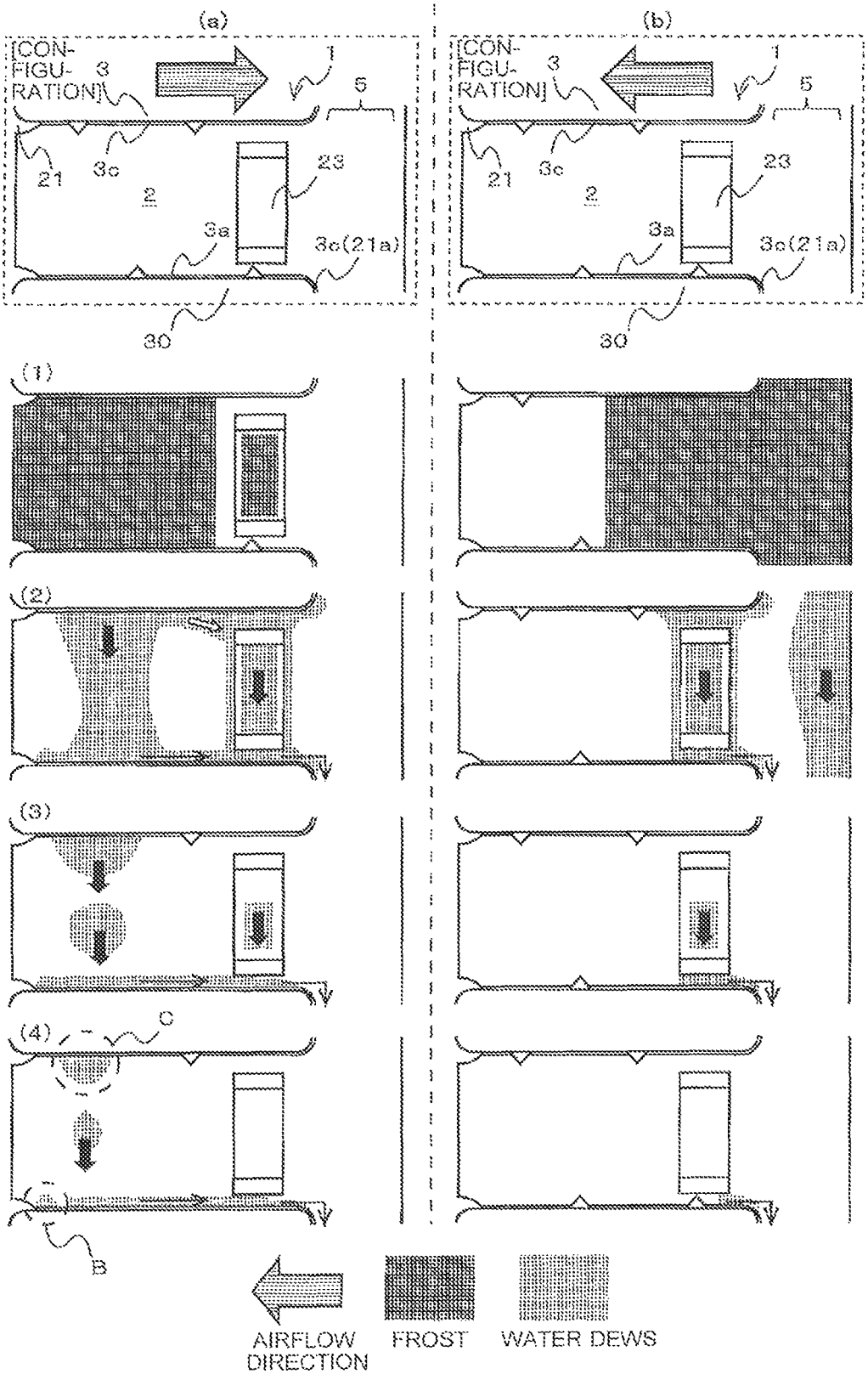
FIG. 9 includes schematic plan views for explaining the water drainage performance of the heat exchanger 1 according to Embodiment 1 of the present invention.

Referring to FIG. 9, description will be given regarding the advantageous effects of the heat exchanger 1 and the refrigeration cycle apparatus 100 according to Embodiment 1, attained because of locating the flat tubes 3, 30, and 300 in the leeward region of the plate fin 2.

As already described, in the case where the flat tubes 3, 30, and 300 are located in the leeward region of the plate fin 2, the flat tube windward lateral surface 3*b* of the flat tube 3 and the flat tube windward lateral surface 3*b* of the flat tube 30 are located on the inner side of the peripheral edge of the plate fin 2, and the drainage channel 5 of the heat exchanger 1 is located in the windward region, in the mainstream direction of the airflow. Conversely, in the case where the flat tubes 3, 30, and 300 are located in the windward region of the plate fin 2, the drainage channel 5 of the heat exchanger 1 is located in the leeward region, in the mainstream direction of the airflow.

FIG. 9 includes schematic plan views for explaining the water drainage performance of the heat exchanger 1 according to Embodiment 1. In FIG. 9, solid block arrows represent the gravity, blank block arrows represent the force originating from the capillary action, and solid line arrows represent the flow direction of the water dews. FIG. 9 shows the comparison between the heat exchanger 1 in which the drainage channel 5 is located in the leeward region (configuration (a)), and the heat exchanger 1 according to Embodiment 1, in which the drainage channel 5 is located in the windward region (configuration (b)). The slit-shaped elevated portions 23 of the heat exchanger 1, respectively shown in (a) and (b) of FIG. 9, are both located close to the windward end portion 21*a* of the recessed portion 21, and between the plurality of recessed portions 21. Therefore, FIG. 9 includes schematic plan views showing a difference in drainage performance arising from the difference in airflow direction, in the heat exchanger 1 in which the elevated portion 23 is located close to the drainage channel 5.

As shown in (a) of FIG. 9, in the case where the drainage channel 5 of the heat exchanger 1 is located in the leeward region, frost and ice are concentratedly stuck to the windward region of the heat exchanger 1 (No. 1). The frost and ice are also stuck to the elevated portion 23 (No. 1). The water dews formed on the flat tube lower surface 3*c* during the defrosting operation fall onto the flat tube upper surface 3*a*, owing to the gravity (No. 2). A part of the water dews formed on the flat tube lower surface 3*c* is discharged to the flat tube upper surface 3*a* through the elevated portion 23, located in the leeward region, owing to the capillary action and the gravity (No. 2). A major part of the water dews deposited on the flat tube upper surface 3*a* migrates to the flat tube lower surface 3*c*, through the flat tube windward lateral surface 3*b* (No. 3). However, a part of the water dews, deposited in the windward region of the flat tube upper surface 3*a*, remains in the windward region of the flat tube upper surface 3*a*, because of being located distant from the flat tube windward lateral surface 3*b* (No. 4). Another part of the water dews formed in the windward region of the flat tube lower surface 3*c* is not subjected to the force originating from the capillary action. Accordingly, when the gravity of the water dews formed in the windward region is smaller than the normal force mainly originating from surface tension, such water dews remain stuck to the flat tube lower surface 3*c* (No. 4). In the heat exchanger 1 shown in (a) of FIG. 9, therefore, the drainage rate of the water dews becomes more limited with the lapse of time, and the water dews reside in the windward region of the flat tube upper surface and the windward region of the flat tube lower surface 3*c* (remainder B and remainder C of No. 4).

In contrast, in the case where the drainage channel 5 is located in the windward region, as in the heat exchanger 1 according to Embodiment 1 shown in (b) of FIG. 9, frost and ice are stuck to the windward region of the heat exchanger 1 (No. 1). A major part of the water dews, stuck to the drainage channel 5 during the defrosting operation, is discharged from the heat exchanger 1 through the drainage channel 5, owing to the gravity (No. 2). The water dews formed on the flat tube lower surface 3*c* during the defrosting operation are discharged to the flat tube upper surface 3*a* through the elevated portion 23, owing to the capillary action and the gravity (No. 2). The water dews discharged to the flat tube upper surface 3*a* migrate to the flat tube lower surface 3*c*, through the flat tube windward lateral surface 3*b* (No. 3). In the heat exchanger 1 shown in (b) of FIG. 9, therefore, the drainage rate of the water dews can be improved, and thus the amount of the water dews residing on the flat tube upper surface 3*a* and the flat tube lower surface 3*c* can be reduced (No. 4).

Thus, Embodiment 1 provides, by locating the flat tubes 3, 30, and 300 in the leeward region of the plate fins 2, the heat exchanger 1 and the refrigeration cycle apparatus 100 capable of improving the drainage rate of the water dews, thereby reducing the amount of the water dews residing on the flat tube lower surface 3*c*.

Figure 10:
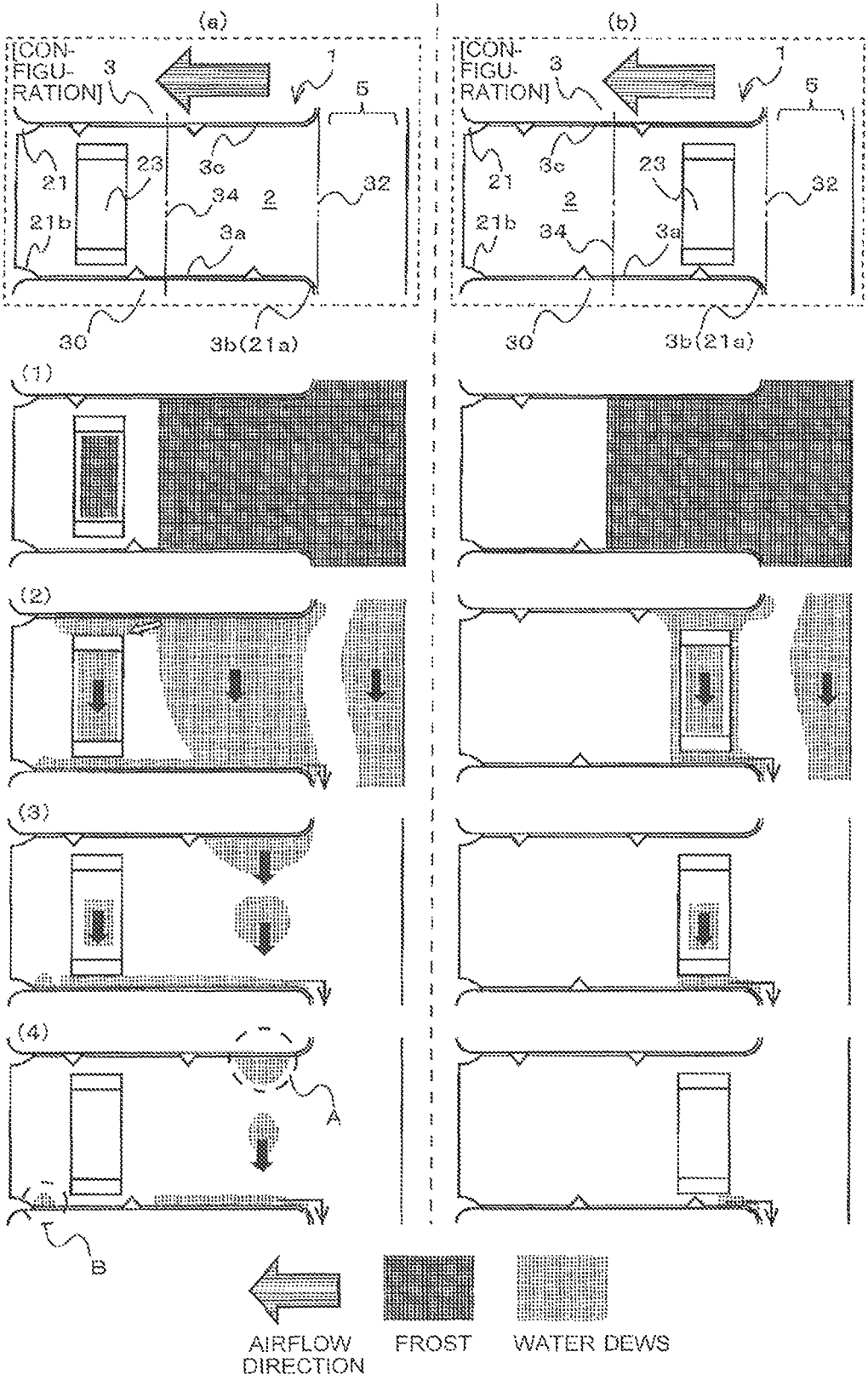
FIG. 10 includes schematic plan views for explaining the water drainage performance of the heat exchanger 1 according to Embodiment 1 of the present invention.

Referring now to FIG. 10, description will be given regarding the advantageous effects of the heat exchanger 1 according to Embodiment 1, attained by locating the elevated portion 23 close to the windward end portion 21*a* of the recessed portion 21, in other words, between the first imaginary plane 32 and the second imaginary plane 34.

FIG. 10 includes schematic plan views for explaining the water drainage performance of the heat exchanger 1 according to Embodiment 1. In FIG. 10, solid block arrows represent the gravity, blank block arrows represent the force originating from the capillary action, and solid line arrows represent the flow direction of the water dews. FIG. 10 shows the comparison between the heat exchanger 1 in which the elevated portion 23 is located leeward of the second imaginary plane 34 (configuration (a)), and the heat exchanger 1 according to Embodiment 1, in which the elevated portion 23 is located between the first imaginary plane 32 and the second imaginary plane 34 (configuration (b)).

As shown in (a) of FIG. 10, in the case where the elevated portion 23 of the heat exchanger 1 is located leeward of the second imaginary plane 34, frost and ice are concentratedly stuck to the windward region of the heat exchanger 1, including the drainage channel 5 (No. 1). The frost and ice are also stuck to the elevated portion 23 (No. 1). A major part of the water dews stuck to the drainage channel 5 during the defrosting operation is discharged from the heat exchanger 1 through the drainage channel 5, owing to the gravity (No. 2). The water dews formed on the flat tube lower surface 3*c* during the defrosting operation fall onto the flat tube upper surface 3*a* owing to the gravity, when the gravity of the water dews exceeds the normal force mainly originating from surface tension (No. 2). A part of the water dews formed on the flat tube lower surface 3*c* is discharged to the flat tube upper surface 3*a* through the elevated portion 23, located in the leeward region, owing to the capillary action and the gravity (No. 2). A major part of the water dews deposited on the flat tube upper surface 3*a* migrates to the flat tube lower surface 3*c*, through the flat tube windward lateral surface 3*b* (No. 3). However, a part of the water dews, deposited in the leeward region of the flat tube upper surface 3*a*, remains in the leeward region of the flat tube upper surface 3*a*, because of being located distant from the flat tube windward lateral surface 3*b* (No. 4). Another part of the water dews formed in the windward region of the flat tube lower surface 3*c* is not subjected to the force originating from the capillary action. Accordingly, when the gravity of the water dews formed in the windward region is smaller than the normal force mainly originating from surface tension, such water dews remain stuck to the flat tube lower surface 3*c* (No. 4). In the heat exchanger 1 shown in (a) of FIG. 10, therefore, the drainage rate of the water dews becomes more limited with the lapse of time, and the water dews reside in the windward region of the flat tube lower surface 3*c* and the leeward region of the flat tube upper surface 3*a* (remainder A and remainder B of No. 4).

In contrast, in the case where the elevated portion 23 is located close to the windward end portion 21*a* of the recessed portion 21, as in the heat exchanger 1 according to Embodiment 1 shown in (b) of FIG. 10, frost and ice are stuck to the windward region of the heat exchanger 1 (No. 1). A major part of the water dews, stuck to the drainage channel 5 during the defrosting operation, is discharged from the heat exchanger 1 through the drainage channel 5, owing to the gravity (No. 2). The water dews formed on the flat tube lower surface 3*c* during the defrosting operation are discharged to the flat tube upper surface 3*a* through the elevated portion 23, owing to the capillary action and the gravity (No. 2). The water dews discharged to the flat tube upper surface 3*a* migrate to the flat tube lower surface 3*c*, through the flat tube windward lateral surface 3*b* (No. 3). In the heat exchanger 1 shown in (b) of FIG. 10, therefore, the drainage rate of the water dews can be improved, and thus the amount of the water dews residing on the flat tube upper surface 3*a* and the flat tube lower surface 3*c* can be reduced (No. 4).

Thus, Embodiment 1 provides, by locating the elevated portion 23 between the first imaginary plane 32 and the second imaginary plane 34, the heat exchanger 1 and the refrigeration cycle apparatus 100 capable of improving the drainage rate of the water dews, thereby reducing the amount of the water dews residing on the flat tube upper surface 3*a* and the flat tube lower surface 3*c*.

As described above, in the heat exchanger 1 according to Embodiment 1, a major part of the water dews stuck to the drainage channel 5 is discharged from the heat exchanger 1 through the drainage channel 5 owing to the gravity, immediately after the frost starts to be melted by the defrosting operation. Therefore, Embodiment 1 provides the heat exchanger 1 that contributes to reducing energy consumption, by reducing the calorific value required for the defrosting operation and shortening the time required for defrosting.

In the heat exchanger 1 according to Embodiment 1, further, the water dews formed on the flat tube upper surface 3*a* and the flat tube lower surface 3*c* by surface tension can be smoothly discharged downward. Therefore, the time required for defrosting can be further shortened.

A large amount of frost is formed on the heat exchanger 1 immediately after the start of the defrosting operation, and therefore a major part of the water dews is discharged downward through the drainage channel 5, owing to the gravity. On the other hand, the water dews that have not been discharged through the drainage channel 5 migrate from the flat tube upper surface 3*a* to the flat tube lower surface 3*c* through the flat tube windward lateral surface 3*b*, owing to the effect of the surface tension. Since the flat tube lower surface 3*c* has a flat shape, a larger gravity force is required for the water dews to fall against the normal force mainly originating from surface tension. Therefore, in the case where the elevated portion 23 is not provided, the water dews are prone to reside on the flat tube lower surface 3*c*, which leads to a limitation of the drainage rate during the defrosting operation.

For example, in the case where the water dews remain in the heat exchanger 1 after the air-conditioning apparatus finishes the defrosting operation and starts the heating operation, the water dews are again frozen in the heat exchanger 1. The frozen water dews may damage the flat tubes 3, 30, and 300, and may therefore degrade the reliability of the heat exchanger 1. In addition, the airflow path 4 of the heat exchanger 1 may be clogged by ice stuck to the heat exchanger 1. When the airflow path 4 of the heat exchanger 1 is clogged, airflow resistance of the heat exchanger 1 increases, and resistance against frost formation is degraded. Thus, in case that the duration of the defrosting operation for the heat exchanger 1 is prolonged because of the freezing of the water dews, the average heating capacity is degraded, and also reduction in energy consumption becomes unable to be achieved.

However, in the heat exchanger 1 according to Embodiment 1, the elevated portion 23 is located close to the windward end portion 21*a* of the recessed portion 21, and between the plurality of recessed portions 21. The elevated portion 23 serves to generate a force originating from the capillary action, in the space between the elevated portion 23 and the plate fin 2. The water dews formed on the flat tube lower surface 3*c* during the defrosting operation are discharged to the flat tube upper surface 3*a* through the elevated portion 23, owing to the capillary action and the gravity. Therefore, the configuration according to Embodiment 1 improves the drainage rate of the water dews, to thereby reduce the amount of the water dews residing on the flat tube upper surface 3*a* and the flat tube lower surface 3*c*. In addition, the configuration according to Embodiment 1 prevents degradation of the average heating capacity, and thus contributes to reducing the energy consumption. Further, the flat tubes 3, 30, and 300 can be prevented from being damaged by the frozen water, and hence leakage of the refrigerant can be prevented. Consequently, the safety of the heat exchanger 1 can be secured.

In the heat exchanger 1 according to Embodiment 1, the elevated portion 23 can be formed in a slit shape. The slit can be formed by cutting the flat portion of the plate fin 2 in the region between the plurality of recessed portions 21, and elevating the cut portion in the direction orthogonal to the airflow direction. Therefore, the structure that allows the water dews formed on the flat tubes 3, 30, and 300 to be discharged utilizing the capillary action can be easily realized in the heat exchanger 1.

In the heat exchanger 1 according to Embodiment 1, the elevated portion 23 may be formed in a louver shape. In the case where the elevated portion 23 is of the louver shape also, the water dews formed on the flat tubes 3, 30, and 300 can be discharged, with the effect of the capillary action.

In the heat exchanger 1 according to Embodiment 1, further, two or more louvers may be provided, such that the louvers are adjacent to each other in a longitudinal direction of the cross-section of the flat tube 3. The louvers are cut and elevated so as to be obliquely bent, and hence the force originating from the capillary action, generated in the space between the louver and the plate fin 2, may be reduced. However, locating a plurality of (e.g., two) louvers adjacent to each other in the horizontal direction allows the capillary action to take place in the narrow space between the louvers, and therefore the water dews formed on the flat tubes 3, 30, and 300 can be efficiently discharged.

A manufacturing method of the heat exchanger 1 according to Embodiment 1 will be described hereunder.

The plate fin 2 including the recessed portions 21, in which the flat tubes 3, 30, and 300 can be inserted, may be manufactured by pressing a metal plate with a die of a predetermined shape. To manufacture the plate fin 2, it is preferable to employ a metal material having a high thermal conductivity, such as aluminum, an aluminum alloy, or copper. The metal plate from which the plate fin 2 is manufactured may be the same material as that of the flat tubes 3, 30, and 300, or a different material.

The slit-shaped elevated portion 23 is formed in the flat portion of the plate fin 2, in the region between the recessed portions 21. First, the flat portion of the plate fin 2 is linearly cut at two positions close to the windward end portion 21*a* of the recessed portion 21, in the direction orthogonal to the ceiling portion 21*c* (or bottom portion 21*d*) of the recessed portion 21, so as to define the slit windward edge 23*c* and the slit leeward edge 23*d*. A horizontal line segment connecting the upper ends of the respective cut lines defines the slit upper end 23*a*, and a horizontal line segment connecting the lower ends of the respective cut lines defines the slit lower end 23*b*. Then the flat portion between the cut lines is squeezed out by plastic deformation, so that the slit flat portion 23*e* parallel to the plate fin 2, the slit upper portion 23*f*, and the slit lower portion 23*g* are formed. The slit flat portion 23*e* is formed so as to be parallel to the plate fin 2. The slit upper portion 23*f* is formed between the slit upper end 23*a* and the upper end of the slit flat portion 23*e*, so as to extend obliquely downward when viewed from the windward side. The slit lower portion 23*g* is formed between the slit lower end 23*b* and the lower end of the slit flat portion 23*e*, so as to extend obliquely upward when viewed from the windward side.

The fin collar 25 is formed to fix the flat tube 3, 30, or 300 to the plate fin 2. The fin collar 25 is formed by perpendicularly erecting the peripheral edge of the recessed portion 21 of the plate fin 2.

Figure 11:
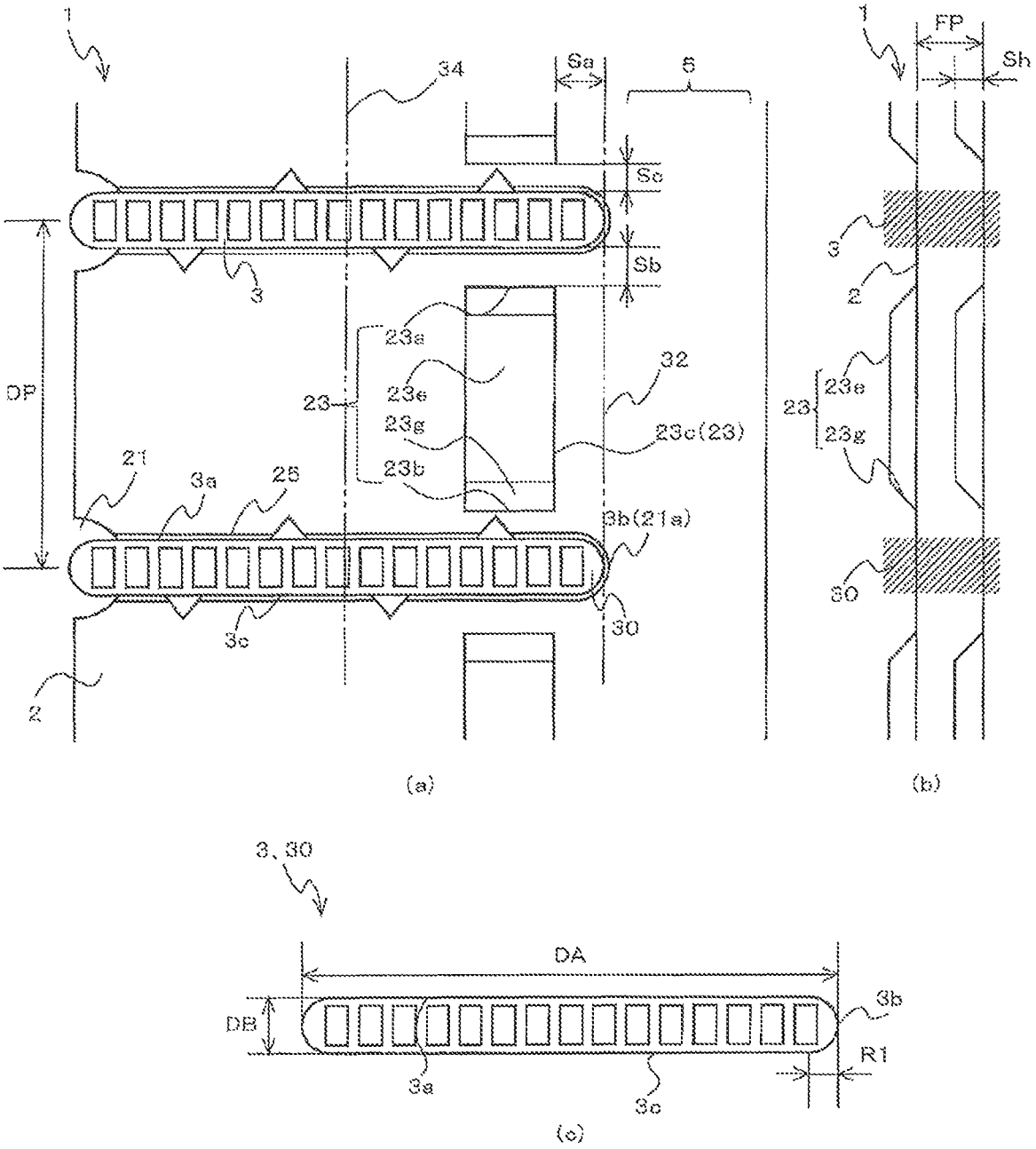
FIG. 11 includes schematic plan views and a side view, each showing dimensions of a part of the heat exchanger 1 according to Embodiment 1 of the present invention.

Here, the position where the slit-shaped elevated portion 23 is to be formed will be described in further detail with reference to FIG. 11. FIG. 11 includes schematic plan views and a side view, each showing dimensions of a part of the heat exchanger 1 according to Embodiment 1.

The plan view (a) of FIG. 11 illustrates a part of the heat exchanger 1 shown in FIG. 1. As shown in (a) of FIG. 11, a shortest distance between the first imaginary plane 32, connecting the flat tube windward lateral surface 3*b* of the flat tube 3 and the flat tube windward lateral surface 3*b* of the flat tube 30, and the slit windward edge 23*c* will be defined as Sa. A shortest distance between the slit upper end 23*a* and the flat tube lower surface 3*c* will be defined as Sb, and a shortest distance between the slit lower end 23*b* and the flat tube upper surface 3*a* will be defined as Sc. Further, a shortest distance between the respective centers of the flat tube 3 and the flat tube 30 set in the heat exchanger 1 will be defined as DP.

The side view (b) of FIG. 11 illustrates a part of the heat exchanger shown in FIG. 2. As shown in (b) of FIG. 11, an elevation height of the slit flat portion 23*e* from the flat portion of the plate fin 2 (hereinafter referred to as "slit elevation height") will be defined as Sh. In addition, a minimum pitch between the plurality of plate fins 2 will be defined as FP.

The plan view (c) of FIG. 11 corresponds to the flat tubes 3 and 30 shown in (a) of FIG. 5. As shown in (c) of FIG. 11, a width of the flat tube 3 (or flat tube 30) in the longitudinal direction of the cross-section will be defined as DA. A width of the flat tube 3 (or flat tube 30) in the lateral direction of the cross-section will be defined as DB. Further, a shortest distance in the horizontal direction, between the extreme end of the flat tube windward lateral surface 3*b* of the flat tube 3 (or flat tube 30) on the windward side and the flat tube upper surface 3*a* (or flat tube lower surface 3*c*) of the flat tube 3 (or flat tube 30), will be defined as R1.

The slit elevation height Sh of the elevated portion 23 will be described hereunder. With an increase of the elevation height Sh, the space defined between the plate fin 2 and the slit flat portion 23*e* becomes narrower, and hence a greater force can be obtained from the capillary action. Therefore, the increase of the slit elevation height Sh leads to an improved drainage performance. On the other hand, the increase of the slit elevation height Sh leads to an increased load imposed on the slit lower portion 23*g*, and hence the elevated portion 23 (e.g., slit flat portion 23*e*) may be broken. Accordingly, the increase of the slit elevation height Sh may result in degraded heat transfer performance of the heat exchanger 1, and in degraded reliability of the heat exchanger 1. Therefore, the elevated portion 23 is formed such that the slit elevation height Sh falls within a range of $\frac{1}{5} \leq (Sh/FP) \leq \frac{1}{2}$, with respect to the minimum pitch FP between the plurality of plate fins 2.

The distance Sa (shortest distance) between the slit windward edge 23*c* and the flat tube windward lateral surface 3*b* will be described. Since the elevated portion 23 is formed in the flat portion of the plate fin 2 in the region between the plurality of recessed portions 21 in Embodiment 1, the slit windward edge 23*c* is located leeward of the extreme end of the flat tube windward lateral surface 3*b* of the flat tube 3 (or flat tube 30) on the windward side. Accordingly, although the elevated portion 23 is barely likely to degrade the buckling resistance of the drainage channel 5, the presence of the elevated portion 23 in the vicinity of the drainage channel 5 may incur concentration of stress to the elevated portion 23. In addition, forming the elevated portion 23 such that the slit windward edge 23*c* is located under the flat tube lower surface 3*c* allows the water dews formed on the flat tube lower surface 3*c* to be effectively discharged utilizing the capillary action. Therefore, the elevated portion 23 is formed such that the distance Sa between the slit windward edge 23*c* and the flat tube windward lateral surface 3*b* falls within a range of $(DA/2) > Sa \geq R1$.

The distance Sb (shortest distance) between the slit upper end 23*a* and the flat tube lower surface 3*c* will be described. In Embodiment 1, the elevated portion 23 is provided to improve the drainage efficiency of the water dews on the flat tube lower surface 3*c*, utilizing the capillary action. Reducing the distance Sb leads to a reduced size of the water dew (i.e., weight of the water dew) that can be discharged by the capillary action, and therefore the water dews formed on the flat tube lower surface 3*c* can be effectively discharged. On the other hand, the reduction of the distance Sb results in reduction of the distance between the slit upper end 23*a* and the recessed portion 21, and therefore the strength of the slit portion may decline, and the plate fin 2 may buckle when the flat tube 3 is inserted therein. In addition, in the forming process of the fin collar 25, a flat region of the plate fin 2, for fixing the fin collar 25, has to be secured in the periphery of the recessed portion 21. Therefore, the elevated portion 23 is formed such that the distance Sb between the slit upper end 23*a* and the flat tube lower surface 3*c* falls within a range of $1 \leq Sb\ (mm) \leq 3$.

The distance Sc (shortest distance) between the slit lower end 23*b* and the flat tube upper surface 3*a* will be described. Reducing the distance Sc assures that the elevated portion 23 can conduct the water dews to a region of the flat tube upper surface 3*a* in the vicinity of the flat tube windward lateral surface 3*b*, and therefore reliability on the drainage performance can be improved. On the other hand, reducing the distance Sc results in reduction of the distance between the slit lower end 23*b* and the recessed portion 21, and therefore the strength of the slit portion may decline and the plate fin 2 may buckle when the flat tube 3 is inserted therein. In addition, when the distance Sc is shortened, the water dews formed on the flat tube upper surface 3*a* may be sucked vertically upward by the capillary action caused by the elevated portion 23, and hence the drainage efficiency may be degraded. Further, the water dews flowing along the elevated portion 23 are barely likely to reside thereon owing to the surface tension serving upward. Therefore, the elevated portion 23 is formed such that the distance Sc between the slit lower end 23*b* and the flat tube upper surface 3*a* falls within a range of $1.5 \leq Sc(mm) \leq (DP-DB)/2$.

The flat tubes 3 are respectively inserted in the plurality of recessed portions 21 of the plate fin 2 formed as above, and closely joined to the fin collar 25 formed on the plate fin 2, by brazing in a furnace or by an adhesive. Further, the end portions of the flat tube 3 are brazed to non-illustrated distribution pipes or header pipes to allow the refrigerant to flow through the refrigerant flow path in the heat exchanger 1.

As described thus far, the arrangement according to Embodiment 1 provides the heat exchanger 1 that exhibits an improved drainage performance of the water originating from the defrosting operation, with a simple process of forming the elevated portion 23 on the plate fin 2. Therefore, the configuration according to Embodiment 1 contributes to reducing the size and weight of the heat exchanger 1.

According to Embodiment 1, a plurality of plate fins 2 are arranged with a spacing between each other, such that the respective surfaces oppose each other, and the ratio Sh/FP, in other words, the ratio of the slit elevation height Sh to the minimum pitch FP between the plurality of plate fins 2 can be set to fall within the range of $\frac{1}{5} \leq Sh/FP \leq \frac{1}{2}$. With the mentioned configuration, the improved drainage performance of the heat exchanger 1 can be attained, and yet the degradation in reliability of the heat exchanger 1 can be avoided.

In Embodiment 1, the flat tube 3 (exemplifying the first flat tube) is located above the flat tube 30 (second flat tube), and the distance Sa between the first imaginary plane 32 and the slit portion can be set to fall within the range of $(DA/2) > Sa \geq R1$, where R1 represents the distance between the extreme end of the flat tube windward lateral surface 3*b* (exemplifying the first windward end portion) of the flat tube 3 on the windward side, and the flat tube lower surface 3*c* (exemplifying the first flat surface portion) of the flat tube 3, and DA represents the width of the flat tube 3 (exemplifying the first flat tube) in the longitudinal direction of the cross-section. With the mentioned configuration, the improved drainage performance of the heat exchanger 1 can be attained, without compromising the buckling resistance of the drainage channel 5.

In Embodiment 1, further, the flat tube 3 (exemplifying the first flat tube) is located above the flat tube 30 (second flat tube), and the distance Sb between the flat tube lower surface 3*c* (exemplifying the first flat surface portion) of the flat tube 3 and the slit portion can be set to fall within the range of $1\ mm \leq Sb \leq 3\ mm$. With the mentioned configuration, an improved drainage performance of the heat exchanger 1 can be attained, without compromising the buckling resistance of the plate fin 2.

Further, in Embodiment 1, the flat tube 3 (exemplifying the first flat tube) is located above the flat tube 30 (second flat tube), and the distance Sc between the slit portion and the flat tube upper surface 3*a* (exemplifying the second flat surface portion) of the flat tube 30 can be set to fall within the range of $1.5\ mm \leq Sc \leq (DP-DB)/2$, where DP represents the distance between the respective centers of the flat tube 3 (exemplifying the first flat tube) and the flat tube 30 (second flat tube), and DB represents the width of the flat tube 30 (exemplifying the second flat tube) in the lateral direction of the cross-section. With the mentioned configuration, an improved drainage performance of the heat exchanger 1 can be attained, without compromising the buckling resistance of the plate fin 2.

Embodiment 2

Figure 12:
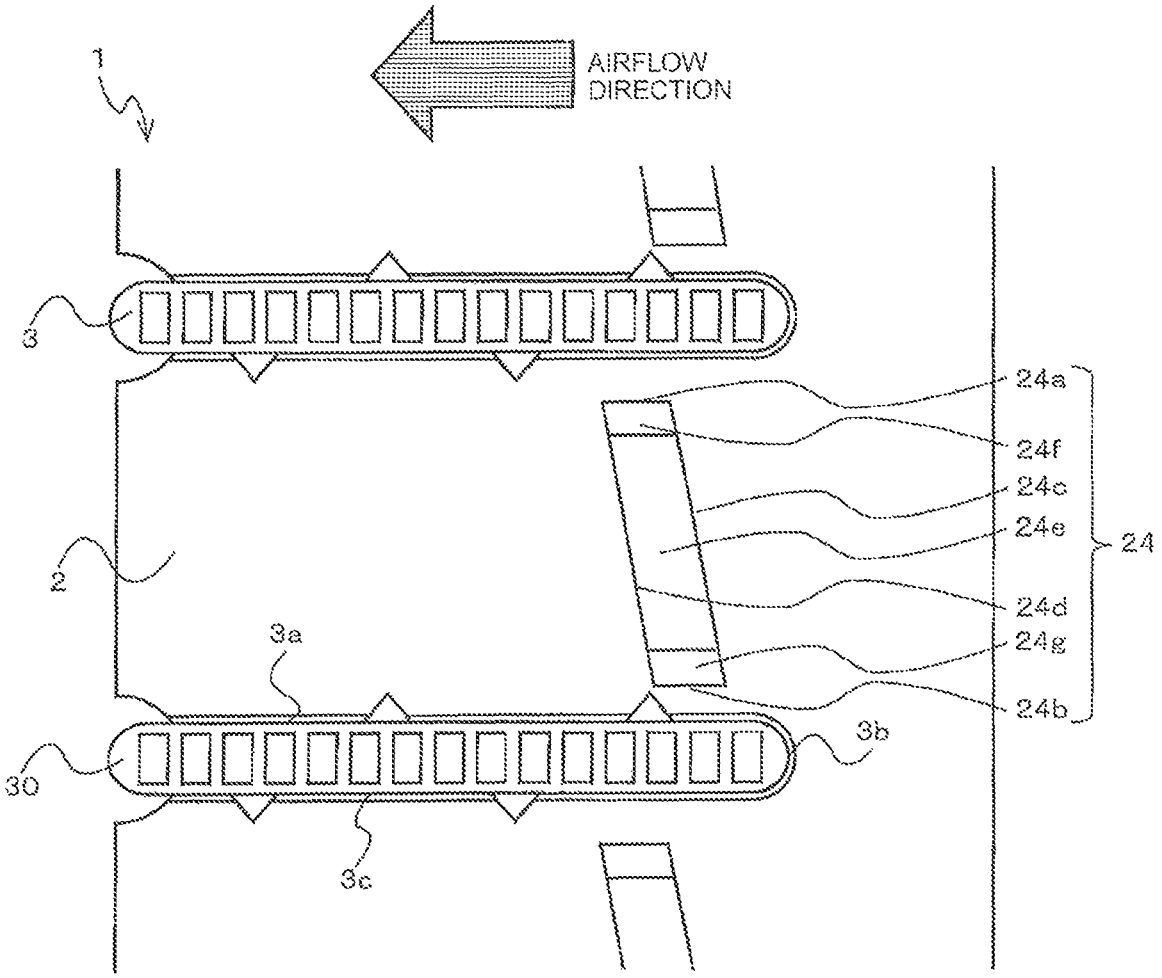
FIG. 12 is a schematic plan view showing a part of the heat exchanger 1 according to Embodiment 2 of the present invention.

Referring now to FIG. 12, the heat exchanger 1 according to Embodiment 2 of the present invention will be described. FIG. 12 is a schematic plan view showing a part of the heat exchanger 1 according to Embodiment 2.

An elevated portion 24 according to Embodiment 2 is formed in a slit shape. The elevated portion 24 includes a slit upper end 24*a*, a slit lower end 24*b*, a slit windward edge 24*c*, a slit leeward edge 24*d*, a slit flat portion 24*e*, a slit upper portion 24*f*, and a slit lower portion 24*g*. The slit windward edge 24*c* and the slit leeward edge 24*d* are linear cut portions of the same length and parallel to each other. In Embodiment 2, the upper end of the slit windward edge 24*c* is located leeward of the lower end thereof. Accordingly, the upper end of the slit leeward edge 24*d* is located leeward of the lower end of the slit leeward edge 24*d*. A line segment connecting the respective upper ends of the slit windward edge 24*c* and the slit leeward edge 24*d* defines the slit upper end 24*a* extending in the horizontal direction. A line segment connecting the respective lower ends of the slit windward edge 24*c* and the slit leeward edge 24*d* defines the slit lower end 24*b* extending in the horizontal direction. The slit flat portion 24*e* is located in a space between the plurality of plate fins 2, so as to extend in the vertical direction when viewed from the windward side. The slit upper portion 24*f* is formed between the slit upper end 24*a* and the upper end of the slit flat portion 24*e*, so as to extend obliquely downward when viewed from the windward side. The slit lower portion 24*g* is formed between the slit lower end 24*b* and the lower end of the slit flat portion 24*e*, so as to extend obliquely upward when viewed from the windward side.

The slit-shaped elevated portion 24 is formed in a flat portion of the plate fin 2 in a region between the recessed portions 21. First, the flat portion of the plate fin 2 is linearly cut at two positions parallel to each other, close to the windward end portion 21*a* of the recessed portion 21, so as to define the slit windward edge 24*c* and the slit leeward edge 24*d*. In Embodiment 2, the cutting is performed such that the upper end of the slit windward edge 24*c* is located leeward of the lower end thereof. Accordingly, the cutting is performed such that also the upper end of the slit leeward edge 24*d* is located leeward of the lower end of the slit leeward edge 24*d*. A horizontal line segment connecting the upper ends of the respective cut lines defines the slit upper end 24*a*, and a horizontal line segment connecting the lower ends of the respective cut lines defines the slit lower end 24*b*. Then the flat portion between the cut lines is squeezed out by plastic deformation, so that the slit flat portion 24*e* parallel to the plate fin 2, the slit upper portion 24*f*, and the slit lower portion 24*g* are formed. The slit flat portion 24*e* is formed so as to be parallel to the plate fin 2. The slit upper portion 24*f* is formed between the slit upper end 24*a* and the upper end of the slit flat portion 24*e*, so as to extend obliquely downward when viewed from the windward side. The slit lower portion 24*g* is formed between the slit lower end 24*b* and the lower end of the slit flat portion 24*e*, so as to extend obliquely upward, when viewed from the windward side.

In Embodiment 2, the elevated portion 24 can be formed on the plate fin 2 such that the lower end of the slit windward edge 24*c* is located close to the flat tube windward lateral surface 3*b*. In addition, the upper end of the slit windward edge 24*c* can be located leeward of the lower end thereof. Thus, the slit lower end 24*b* can be located close to the flat tube windward lateral surface 3*b*, and the slit upper end 24*a* can be located leeward of the slit lower end 24*b*. Therefore, the configuration according to Embodiment 2 allows the water dews discharged to the flat tube upper surface 3*a* through the slit lower end 24*b* to smoothly migrate to the flat tube lower surface 3*c*, through the flat tube windward lateral surface 3*b*. Further, locating the slit upper end 24*a* at the position leeward of the slit lower end 24*b* increases the area over which the water dews formed on the flat tube lower surface 3*c* can be discharged by the capillary action caused by the elevated portion 24.

Embodiment 3

Figure 13:
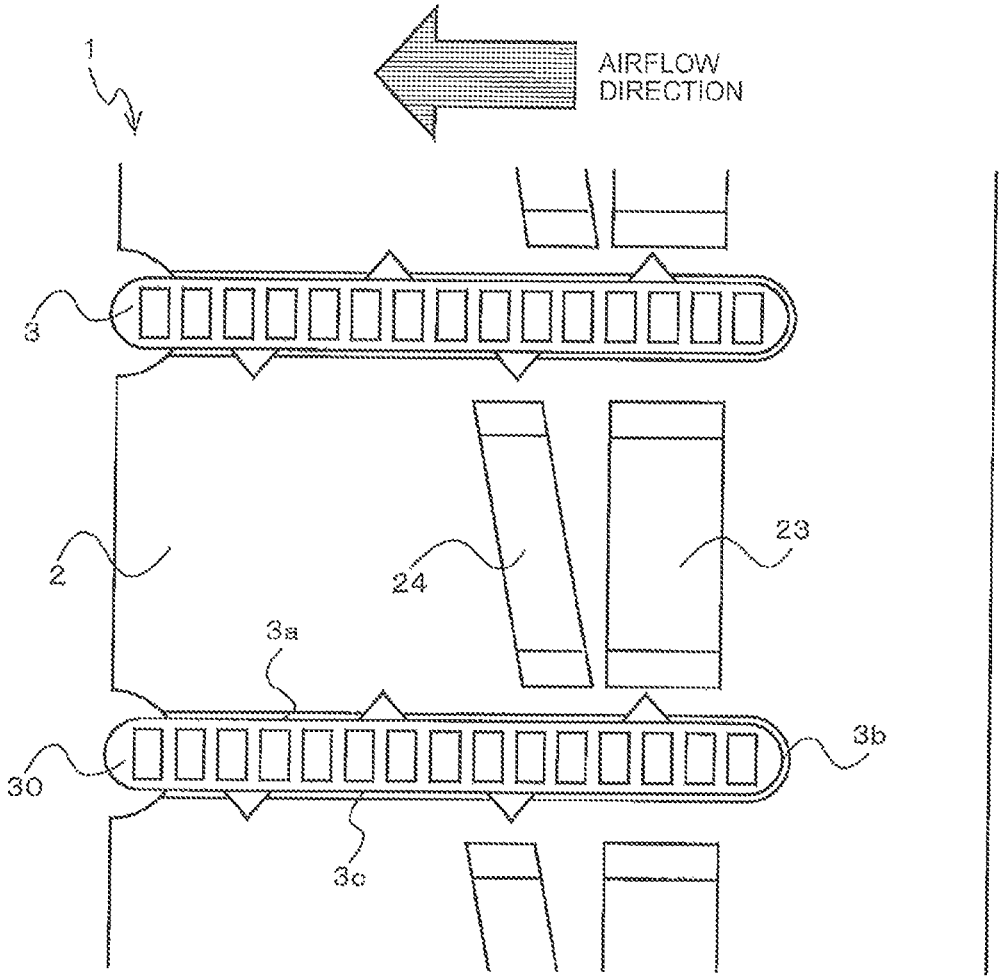
FIG. 13 is a schematic plan view showing a part of the heat exchanger 1 according to Embodiment 3 of the present invention.

Referring to FIG. 13, the heat exchanger 1 according to Embodiment 3 of the present invention will be described. FIG. 13 is a schematic plan view showing a part of the heat exchanger 1 according to Embodiment 3.

In the heat exchanger 1 according to Embodiment 3, the elevated portion 24 of Embodiment 2 is provided leeward of the elevated portion 23 of Embodiment 1. With such configuration of Embodiment 3, the water dews formed on the flat tube lower surface 3*c* can be discharged to the flat tube upper surface 3*a*, by the capillary action caused by the elevated portions 23 and 24. Further, the water dews discharged through the elevated portion 24 is discharged to a region close to the flat tube windward lateral surface 3*b* of the flat tube upper surface 3*a*. Therefore, the configuration according to Embodiment 3 allows the water dews discharged to the flat tube upper surface 3*a* to smoothly migrate to the flat tube lower surface 3*c*, through the flat tube windward lateral surface 3*b*.

Other Embodiments

Various modifications may be made, without limitation to the foregoing Embodiments. For example, a plurality of elevated portions 23 or 24 may be aligned in parallel in the horizontal direction. Alternatively, concave and convex scratches or waffle patterns may be formed on the flat portion of the plate fin 2 in the region between the plurality of recessed portions 21, where the elevated portion is not provided.

In addition, grooves may be formed on the inner wall of the refrigerant flow path 3*e* of the flat tubes 3, 30, and 300, to increase the contact area between the refrigerant and the flat tubes 3, 30, and 300, to thereby improve the heat exchange efficiency.

Further, the present invention is applicable not only to the air-conditioning apparatus, but also to a heat exchanger of various other heat pump apparatuses required to improve the performance, such as a showcase, a refrigeration machine, and a refrigerator.

The invention claimed is:

1. A heat exchanger to which an airflow is supplied from a fan, the heat exchanger comprising:

a first plate fin;

a first flat tube including a first flat surface portion extending in a direction of the airflow supplied from the fan, a first windward end portion located on a windward end portion of the first flat surface portion, and a first leeward end portion located on a leeward end portion of the first flat surface portion, the first flat tube being arranged so as to intersect with the first plate fin; and a second flat tube including a second flat surface portion opposed to the first flat surface portion of the first flat tube and extending in the direction of the airflow, a second windward end portion located on a windward end portion of the second flat surface portion, and a second leeward end portion located on a leeward end portion of the second flat surface portion, the second flat tube being spaced from the first flat tube and arranged so as to intersect with the first plate fin, the first windward end portion and the second windward end portion being located on an inner side of a peripheral edge of the first plate fin, the first plate fin includes only a single elevated portion formed within an area between the first flat tube and the second flat tube, and the single elevated portion being located between a first imaginary plane connecting the first windward end portion and the second windward end portion, and a second imaginary plane connecting a center of the first flat surface portion and a center of the second flat surface portion.

2. The heat exchanger of claim 1, wherein the elevated portion is erected from a slit.

3. The heat exchanger of claim 2, further comprising a second plate fin arranged with a spacing from the first plate fin, wherein the first plate fin and the second plate fin are arranged such that respective surfaces of the first plate fin and the second plate fin oppose each other, and a ratio Sh/FP of a slit elevation height Sh of the elevated portion to a minimum pitch FP between the first plate fin and the second plate fin falls within a range of $\frac{1}{5} \leq Sh/FP \leq \frac{1}{2}$.

4. The heat exchanger of claim 2, wherein the first flat tube is located above the second flat tube, and a distance Sa between the first imaginary plane and the slit falls within a range of $(DA/2) > Sa \geq R1$, where R1 represents a distance between an extreme end of the first windward end portion on a windward side and the first flat surface portion, and DA represents a width of the first flat tube in a longitudinal direction of a cross-section of the first flat tube.

5. The heat exchanger of claim 2, wherein the first flat tube is located above the second flat tube, and a distance Sb between the first flat surface portion and the slit falls within a range of $1\ mm \leq Sb \leq 3\ mm$.

6. The heat exchanger of claim 2, wherein the first flat tube is located above the second flat tube, and a distance Sc between the slit and the second flat surface portion falls within a range of $Sc \leq (DP-DB)/2$, where DP represents a distance between a center of the first flat tube and a center of the second flat tube, and DB represents a width of the second flat tube in a lateral direction of a cross-section of the second flat tube.

7. The heat exchanger of claim 1, wherein the elevated portion includes a louver.

8. A refrigeration cycle apparatus comprising the heat exchanger of claim 1.

* * * * *